US012570431B2

(12) United States Patent
Hoefte

(10) Patent No.: US 12,570,431 B2
(45) Date of Patent: Mar. 10, 2026

(54) LINED PAPER-BASED CONTAINER

(71) Applicant: The Procter & Gamble Company, Cincinnati, OH (US)

(72) Inventor: Paulus Antonius Augustinus Hoefte, Astene (BE)

(73) Assignee: The Procter & Gamble Company, Cincinnati, OH (US)

( * ) Notice: Subject to any disclaimer, the term of this patent is extended or adjusted under 35 U.S.C. 154(b) by 263 days.

(21) Appl. No.: 18/204,173

(22) Filed: May 31, 2023

(65) Prior Publication Data

US 2024/0400253 A1 Dec. 5, 2024

(51) Int. Cl.

| | |
|---|---|
| ***B65D 77/20*** | (2006.01) |
| ***B65D 5/20*** | (2006.01) |
| ***B65D 5/44*** | (2006.01) |
| ***B65D 5/56*** | (2006.01) |
| ***B65D 5/64*** | (2006.01) |

(52) U.S. Cl.

CPC ..... *B65D 5/445* (2013.01); *B65D 5/2033* (2013.01); *B65D 5/56* (2013.01); *B65D 5/64* (2013.01)

(58) Field of Classification Search

CPC ..... B65D 5/445; B65D 5/321; B65D 5/563; B65D 5/2047; B65D 5/56; B65D 5/2033; B65D 77/2024

USPC .... 206/557; 229/5.5, 5.58, 103.11, 169, 903

See application file for complete search history.

(56) References Cited

U.S. PATENT DOCUMENTS

| | | | | |
|---|---|---|---|---|
| 3,756,495 A | | 9/1973 | Bemiss | |
| 4,257,530 A | * | 3/1981 | Faller | B65B 9/04 229/905 |
| 4,555,381 A | * | 11/1985 | Chazal | B29C 51/165 264/516 |
| 5,253,801 A | * | 10/1993 | Bernstein | B65D 5/2047 229/113 |
| 6,092,687 A | | 7/2000 | Hupp et al. | |
| 6,149,006 A | * | 11/2000 | Brauner | B65D 21/0233 206/557 |
| 11,358,779 B2 | * | 6/2022 | Tye | B65D 77/22 |
| 11,427,374 B2 | | 8/2022 | Mondini et al. | |
| 11,434,038 B2 | * | 9/2022 | Tye | B65D 5/20 |
| 12,103,743 B2 | * | 10/2024 | Mero | B65D 5/0005 |

(Continued)

FOREIGN PATENT DOCUMENTS

| | | |
|---|---|---|
| JP | 2001096644 A | 4/2001 |
| JP | 2001233323 A | 8/2001 |

(Continued)

OTHER PUBLICATIONS

PCT Search Report and Opinion for PCT/US2024/030465 dated Sep. 30, 2024, 16 pages.

(Continued)

*Primary Examiner* — Luan K Bui

(74) *Attorney, Agent, or Firm* — Gary J. Foose

(57) ABSTRACT

A container including a paper-based cradle, a paper-based insert, and a thermoplastic film. The cradle has exterior corner panels that form a transition between the exterior end panels and exterior side panels. The cradle and insert are held together by the thermoplastic film that is thermoformed into conformance with the cradle and insert. The exterior corner panels at the junctures between the exterior end panels and exterior side panel can reduce the potential for defects in the thermoformed thermoplastic film.

24 Claims, 11 Drawing Sheets

(56) References Cited

U.S. PATENT DOCUMENTS

| | | | | |
|---|---|---|---|---|
| 2018/0022529 | A1* | 1/2018 | Tye | B65D 5/563 206/557 |
| 2020/0047975 | A1* | 2/2020 | Tye | B65D 5/2038 |
| 2020/0255200 | A1 | 8/2020 | Mondini et al. | |

FOREIGN PATENT DOCUMENTS

| | | | |
|---|---|---|---|
| JP | 2001270515 | A | 10/2001 |
| JP | 2001278245 | A | 10/2001 |
| JP | 4372942 | B2 | 9/2009 |
| WO | 02085720 | A2 | 10/2002 |
| WO | 2022264022 | A1 | 12/2022 |

OTHER PUBLICATIONS

All Office Actions; U.S. Appl. No. 18/204,164, filed May 31, 2023.
All Office Actions; U.S. Appl. No. 18/204,179, filed May 31, 2023.
Unpublished U.S. Appl. No. 18/204,164, filed May 31, 2023, to Paulus Antonius Augustinus Hoefte.
Unpublished U.S. Appl. No. 18/204,179, filed May 31, 2023, to Paulus Antonius Augustinus Hoefte.

* cited by examiner

LINED PAPER-BASED CONTAINER

FIELD OF THE INVENTION

Paper-based containers having a liner.

BACKGROUND OF THE INVENTION

Lined paper-based containers having the shape of a tray are widely used for packaging. Such containers have a plastic liner in the base of the tray. A plastic sheet material may form the lid of the container. These containers can be useful for ready to eat food products or cold food products intended to be heated in a microwave or traditional oven. Products such as wet wipes and other moisture sensitive products may also be packaged in such containers.

Containers need to be robust enough to protect the contents of the container from the time the product is placed in the container to when the user uses the contents. During this interim period of time, the container may be exposed to variable ambient conditions, loading and unloading cycles, impact, and other similar stressors. Historically, paper-based containers have suffered deficiencies with respect to one or all of the aforesaid stressors that may act on the container. These deficiencies may materialize in that the product contained in the container may be damage or the container may leak product from within the container to the outside environment. This is especially true for lined paper-based tray containers. These containers are typically erected from a flat blank and have a paneled surface. These panels meet at angles that are particularly susceptible to being damaged by locally applied stresses that might occur when the container is dropped or contacted by an object. Moreover, sharp corners that exist on the interior surface of the paper-based frame where the panels meet or where various flaps meet with opposing panels may result in local weakness in the liner thermoformed to conform with the interior of the paper-based frame. The local weakness in the liner may be particularly susceptible to failure.

There is continuing interest in improving the recyclability of containers for products. Lined paper-based containers may offer many advantages over other materials with respect to recycling. The recycling stream for paper-based materials is well developed. One impediment to recycling paper-based containers is that adhesives used to maintain the structure of the container and liners employed in the container to protect the product from the environment before use may not be acceptable into the recycling stream or contaminate the recycling stream by causing stickies in the repulping and recycled paper making processes, especially if container contains a large weight fraction of non-paper materials.

Based on the above there is a continuing unaddressed need for lined paper-based containers that balance the need for robust containers and conveniently recyclable containers.

SUMMARY OF THE INVENTION

A container comprising: a paper-based cradle comprising: a bottom panel; a pair of opposing exterior end panels, wherein each exterior end panel is foldably connected to said bottom panel at an exterior end panel proximal end and extends to an exterior end panel distal end and is directed towards a top of said container, and wherein each exterior end panel comprises opposing exterior end panel lateral edges extending from said exterior end panel proximal end to said exterior end panel distal end; a pair of opposing exterior side panels, wherein each exterior side panel is foldably connected to said bottom panel at an exterior side panel proximal end and extends to an exterior side panel distal end and is directed towards said top of said container, and wherein each exterior side panel comprises opposing exterior side panel lateral edges extending from said exterior side panel proximal end to said exterior side panel distal end; and four exterior corner panels, wherein each corner panel is foldably connected to one said exterior end panel lateral edge or one said exterior side panel lateral edge, wherein individually each exterior corner panel has a corner panel wing foldably connected thereto; wherein individually each corner panel wing is in at least partial facing relationship with one said exterior end panel or one said exterior side panel; a paper-based insert partially inboard of said cradle and comprising: a continuous brim; a pair of interior end panels foldably connected to said brim, wherein each said interior end panel is directed towards a bottom of said container and is in at least partial facing relationship with one said exterior end panel; and a pair of interior side panels foldably connected to said brim, wherein each said interior side panel is directed towards said bottom and is in at least partial facing relationship with one said exterior side panel; and a thermoplastic film inboard of said insert and joined to said brim, said bottom panel, said interior end panels, said interior side panels, said exterior end panels, said exterior side panels, said exterior corner panels, and said corner panel wings.

DETAILED DESCRIPTION OF THE INVENTION

Figure 1:
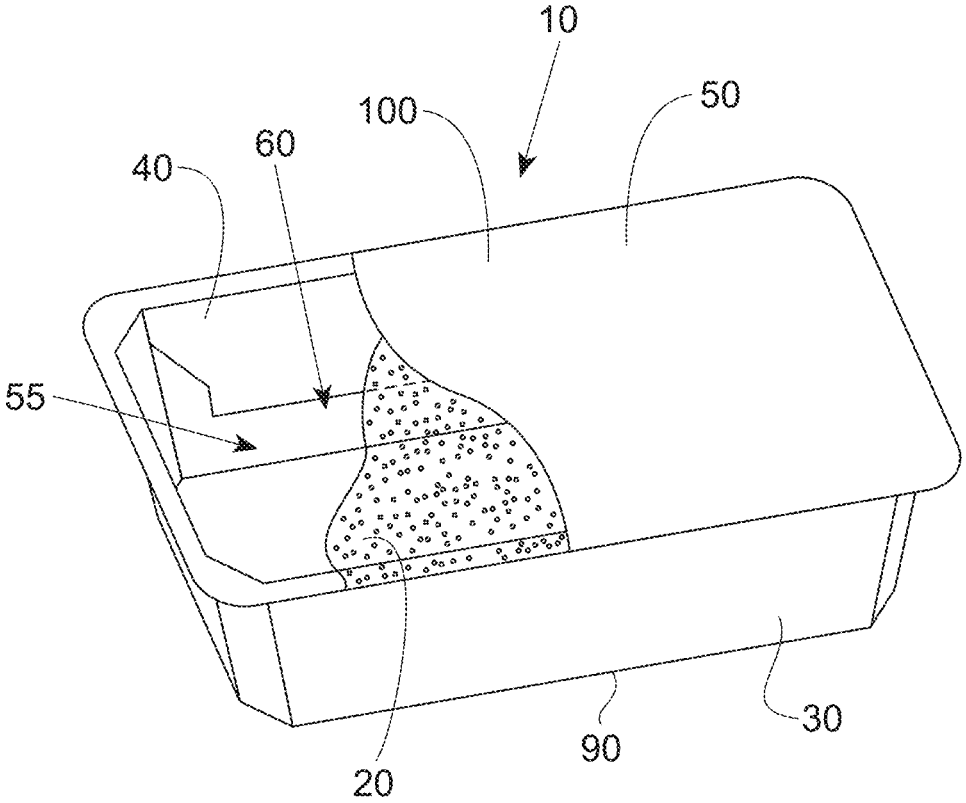
FIG. 1 is a paper-based container.

A structurally robust and recyclable line container 10 is described herein, by way of nonlimiting example as shown in FIG. 1. Structural robustness is provided by the structure of the container 10 at and near the intersections between the panels defining the shape of the container 10. The structure is maintained, at least in part, by the thermoplastic film 20 of the container 10. The thermoplastic film 20 also can act as a liquid tight liner of the container 10.

The thermoplastic film 20 is thermoformed into conformance with the structure defined by the paper-based cradle 30 and paper-based insert 40. During thermoforming, the thermoplastic film 20 is heated to a moldable temperature and is tacky. When the hot tacky thermoplastic film 20 is contacted to a surface and subsequently cools, the thermoplastic film 20 can be joined to certain components of the structure to maintain the various panels and wings described herein in their desired positions. The strength of the of the thermoplastic film 20 joined to the cradle 20 and insert 40 hold the elements of the structure in the desired position to form the container 10.

The container 10 can include a sheet material 50 that extends across the open end 55 of the container 10. The interior space 60 of the container 10 can be between the thermoplastic film 20 and the sheet material 50. The container can have a bottom 90 and a top 100 opposite the bottom 90. The sheet material 50 can be at the top of the container 10. The sheet material 50 can be the lid of the container 10.

After the contents of the container 10 are consumed, the thermoplastic film 20 can be separated from the cradle 30 and insert 40. Being paper-based, the cradle 30 and insert 40 are conveniently recycled. The thermoplastic film 20 may also be recycled separately if a recycling stream for such materials is available. Optionally, the cradle 30, insert 40, and thermoplastic film 20 may be placed in the paper recycling stream if the thermoplastic film 20 constitutes a sufficiently low weight fraction of the combination of the cradle 30, insert 40, and thermoplastic film 20. The cradle 30, insert 40, and thermoplastic film 20 combined can comprise more than 70%, optionally more than 80%, optionally more than 90%, optionally more than 95% by weight cellulose fibers. The cradle 30, insert 40, and thermoplastic film 20 combined can comprise from 80% to 99.99% by weight cellulose fibers. Optionally, the cradle 30, insert 40, and thermoplastic film 20 combined can comprise from 85% to 99.99%, optionally from 85% to 99.99%, optionally from 90% to 99.99%, by weight cellulose fibers. The cradle 30, insert 40, and thermoplastic film 20 can have a combined weight, wherein cellulose fibers constitute more than 80%, optionally more than 85%, optionally more than 90%, optionally more than 95%, optionally from 80% to 99%, optionally from 85% to 99%, optionally from 90% to 99%, optionally from 95% to 99% of said combined weight.

Figure 2:
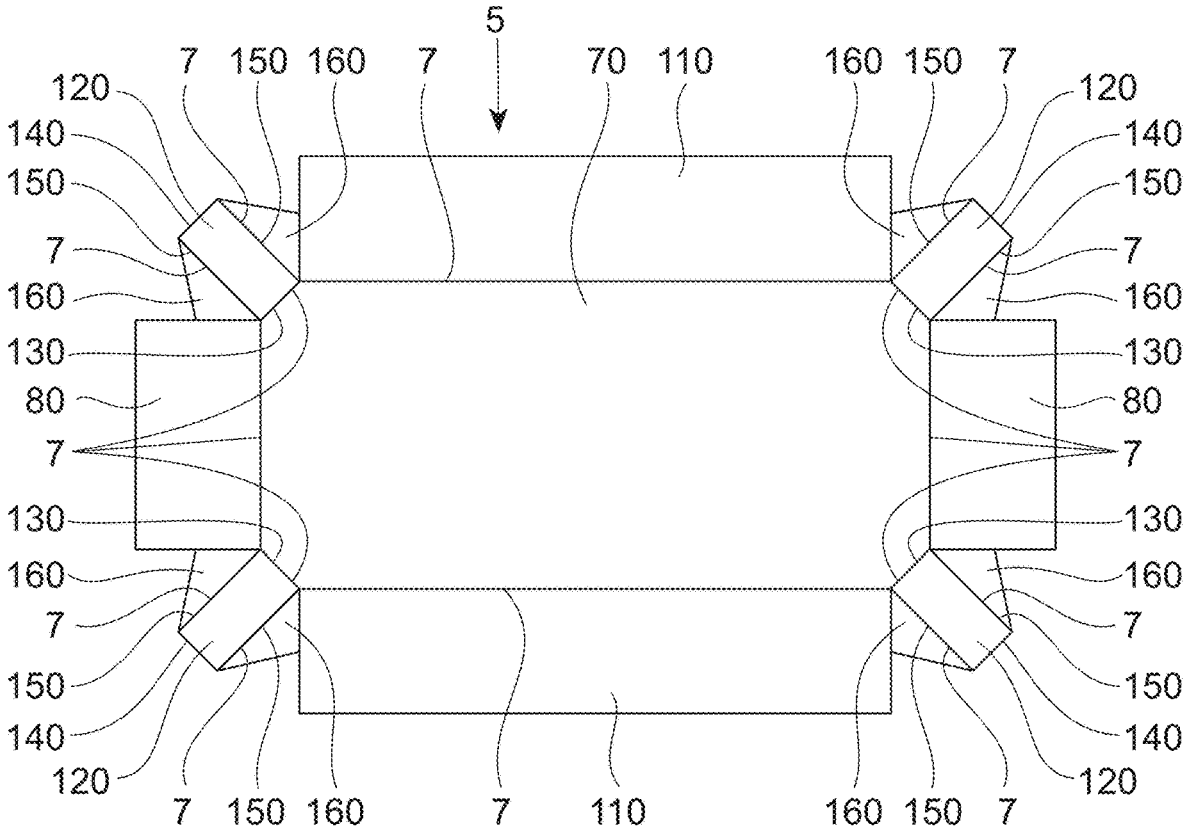
FIG. 2 is a top view of a blank of a cradle.

A blank 5 of the cradle 30 is shown in FIG. 2. The blank 5 of the cradle 30 can be erected to have the same general tray shape as shown in FIG. 1. The cradle 30 can have a bottom panel 70. The bottom panel 70 defines the shape of the bottom of the container 10.

The cradle 30 can further comprise a pair of opposing exterior end panels 80. The exterior end panels 80 are referred to as being exterior since they are positionally exterior of the interior end panels discussed later herein. Each of the exterior end panels 80 can be foldably connected to the bottom panel 70. That is, a fold line 7 can be present between the bottom 70 and a respective exterior end panel 80. To provide for the shape of the cradle 30, each exterior end panel 80 can be directed towards the top 100 of the container 10. The exterior end panels 80 can be folded about the fold lines 7 between the exterior end panels 80 and the bottom panel 70 towards the top 100 of the container 10 to direct the exterior end panels 80 towards the top 100 of the container 10.

The cradle 30 can further comprise a pair of opposing exterior side panels 110. The exterior side panels 110 are referred to as being exterior since they are positionally exterior of the interior side panels discussed later herein. Each of the exterior side panels 110 can be foldably connected to the bottom panel 80 and directed towards the top 100 of the container 10. The exterior side panels 110 can be folded about the fold lines 7 between the exterior side panels 110 and the bottom panel 70 towards the top 100 of the container 10 to direct the exterior side panels 110 towards the top 100 of the container 10.

The cradle 30 can further comprise four exterior corner panels 120. Each of the exterior corner panels 120 can be foldably connected to the bottom panel 70 at an exterior corner panel proximal end 130 and extend to an external corner panel distal end 140. The exterior corner panels 120 can be directed towards the top 100 of the container 10. The exterior corner panels 120 can be folded about a fold line 7 along the external corner panel proximal end 130 between the exterior corner panel 120 and the bottom panel 70 towards the top 100 of the container 10 to direct the exterior corner panels 120 towards the top 100 of the container 10.

The exterior corner panels 120 can provide for a gradual shape transition between the exterior side panels 110 and exterior end panels 80 and the interior side panels and the interior end panels. The gradual transition in shape at the junctures improves the ability to thermoform the thermoplastic film to the cradle 30 and insert 40 as compared to containers that have panels that meet at right angles or containers in which the constituent material is continuous across a corner and thereby potentially has a number of wrinkles or folds to accommodate the deformation of the constituent material into the final shape of the container. Containers in which the panels meet at right angles or are wrinkled or folded around the corner are prone to leakage because small holes may form in the thermoplastic film 20 at the sharp corners or irregular surface of the wrinkled or folded corner. Moreover, the thermoplastic film 20 of such containers having right angles at the corners may have a greater variability in thickness of the thermoformed thermoplastic film 20 as compared to containers having a gradual shape transition between the exterior side panels 110 and the exterior end panels 80.

Each exterior corner panel 120 comprises opposing exterior corner panel lateral edges 150 extending from the exterior corner panel proximal end 130 and the exterior corner panel distal end 140. Individually, each exterior corner panel lateral edge 150 can have a corner panel wing 160 foldably connected thereto. That is, each corner panel wing 160 can extend from a corner panel lateral edge 150 and the boundary between the corner panel wing 160 and the exterior corner panel 120 can be a fold line 7.

Figure 3:
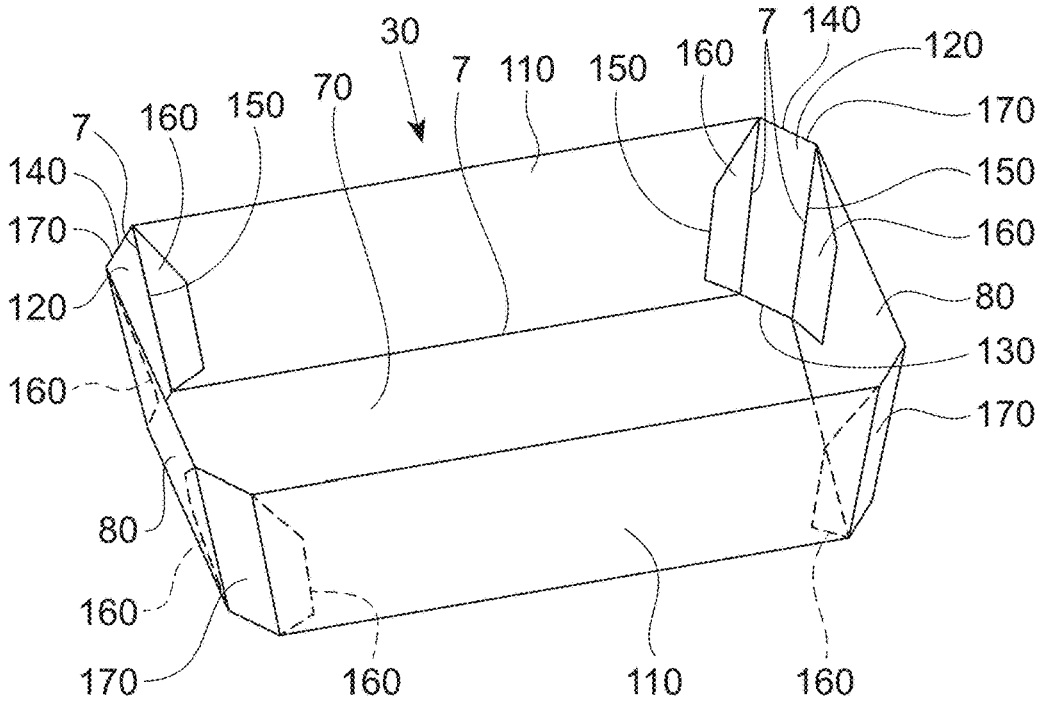
FIG. 3 is a top view of an erected cradle.

When the cradle 30 is erected, individually each exterior corner panel 120 can be positioned to form a juncture 170 between one exterior end panel 80 and one exterior side panel 110 (FIG. 3). When the cradle 30 is erected, for each exterior corner panel 120 one corner panel wing 160 can be in at least partial facing relationship with one exterior end panel 80 and one corner panel wing 160 can be in at least partial facing relationship with one exterior side panel 110. The corner panel wings 160 can be located towards the interior space 60 relative to the exterior side panels 110 and exterior end panels 80.

Cradles 30 in which the exterior corner panels 120 extend from the bottom panel 70 can be beneficial. In the corners of the container 10, the flat interior facing surfaces of the exterior end panel 80, exterior corner panel 120, exterior side panel 110, and the bottom panel 70 meet. The complex geometry of these meeting surfaces can make it difficult to thermoform the thermoplastic film 20 into these corners without forming overly thinned parts or small holes in the thermoplastic film 20. The continuity of the constituent material of the cradle 30 from the bottom panel 70 to the exterior corner panel 120 can provide for continuous support of the thermoplastic film 20 at the transition from the bottom panel 70 to the exterior corner panel 120, thereby reducing the potential for overly thinned parts or small holes in the thermoplastic film 20. Cradles 30 in which the exterior corner panels 120 extend from the exterior end panel 80 or exterior side panel 110 may have a small gap or irregular fit at the location between the bottom panel 70 and the exterior corner panels 120, which may increase the possibility of an overly thinned part or small hole in the thermoformed thermoplastic film 20.

Figure 4:
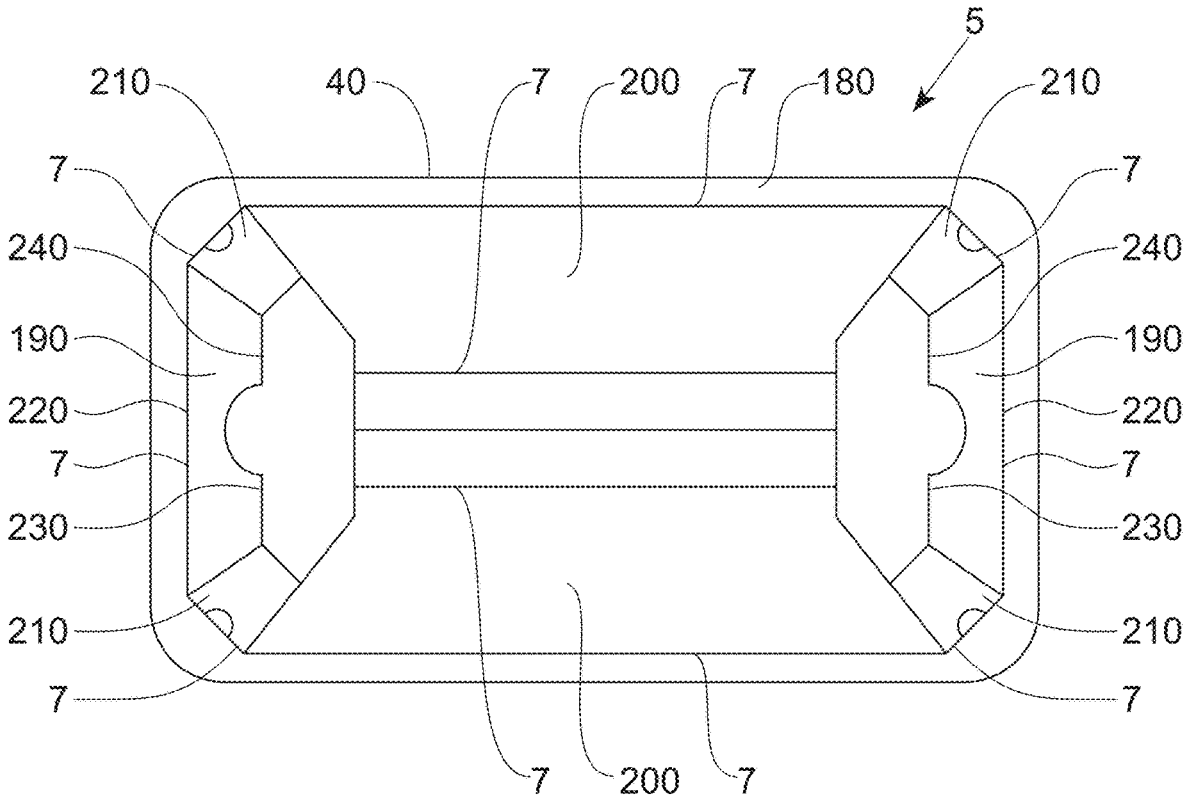
FIG. 4 is a top view of a blank of an insert.

The container 10 can further comprise a paper-based insert 40, a blank 5 of which is shown in FIG. 4. The insert 40 can be inboard of the cradle 30. The insert 40 can comprise a continuous brim 180. When the container 10 is erected and assembled, the brim 180 can extend outboard of the exterior end panels 80 and exterior side panels 110. A continuous brim 180 can be advantageous over a discontinuous brim or a brim having overlapping brim portions. A continuous brim 180 can provide for a uniform surface at which the thermoplastic film 20 can be joined to the brim 180 which can reduce the potential for pinholes in the thermoplastic film. Furthermore, a continuous brim 180 and thermoplastic film 20 joined thereto may provide for a more uniform surface to attach the sheet material 50 to compared to a discontinuous brim or brim having overlapping brim portions.

The insert 40 can further comprise a pair of interior end panels 190 foldably connected to the brim 180. Each interior end panel 190 can be directed towards the bottom 90 of the container 10. The interior end panels 190 can be folded about the fold lines 7 between the interior end panels 190 and the brim 180 towards the bottom 90 of the container 10 to direct the interior end panels 190 towards the bottom 90 of the container 10. When the container 10 is erected, each interior end panel 190 can be in at least partial facing relationship with one exterior end panel 80.

The insert 40 can further comprise a pair of interior side panels 200 foldably connected to the brim 180. Each interior side panel 200 can be directed towards the bottom 90. The interior side panels 200 can be folded about the fold lines 7 between the interior side panels 200 and the brim 180 towards the bottom 90 of the container 10 to direct the interior side panels 200 towards the bottom 90 of the container 10. When the container 10 is erected, each interior side panel 200 can be in at least partial facing relationship with one exterior side panel 110.

The insert 40 can further comprise four interior corner panels 210 foldably connected to the brim 180. The interior corner panels 210 can be folded about the fold lines 7 between the brim 180 and the interior corner panels 210 towards the bottom of the container 10. When the container 10 is erected, each interior corner panel 210 can be in at least partial facing relationship with part of one exterior corner panel 120.

Optionally and individually, each interior end panel 190 can be foldably connected to the brim 180 at an interior end panel proximal end 220 and extend to an interior end panel distal end 230. Each interior end panel distal end 230 can include a concave end profile 240. The concave end profile 240 can provide for more surface area of the exterior end panels 80 to be presented towards the interior space 60 so that the thermoplastic film 20 can be joined thereto.

The container 10 can further comprise a thermoplastic film 20 inboard of the insert 40 and joined to the brim 180, the bottom panel 70, the interior end panels 190, the interior side panels 200, the exterior end panels 80, the exterior side panels 110, and the exterior corner panels 120. The thermoplastic film 20 can be conformed to the interior surface contour defined by portions of the cradle 30 and insert 40 of the assembly of the cradle 30 and the insert 40.

The thermoplastic film 20 is above the moldable temperature of the thermoplastic film 20 when thermoformed into conformance with the interior contour of the assembly of the cradle 30 and insert 40. The hot and tacky thermoplastic film 20 when it subsequently cools can become joined to the brim 180, the bottom panel 70, the interior end panels 190, the interior side panels 200, the exterior end panels 80, the exterior side panels 110, and the exterior corner panels 120. The thermoplastic film 20 can fix the aforesaid components of the cradle 30 and insert 40 in position so that the cradle 30 and insert 40 maintain their assembled shape and become a self-supporting rigid container 10. The container 10 can be devoid of adhesive between parts of the cradle 30 that are in facing relationship with one another and can be devoid of adhesive between parts of the insert 40 in facing relationship with parts of the cradle 30. The cradle 30 and insert 40 can be held together exclusively by the thermoplastic film 20.

Figure 5:
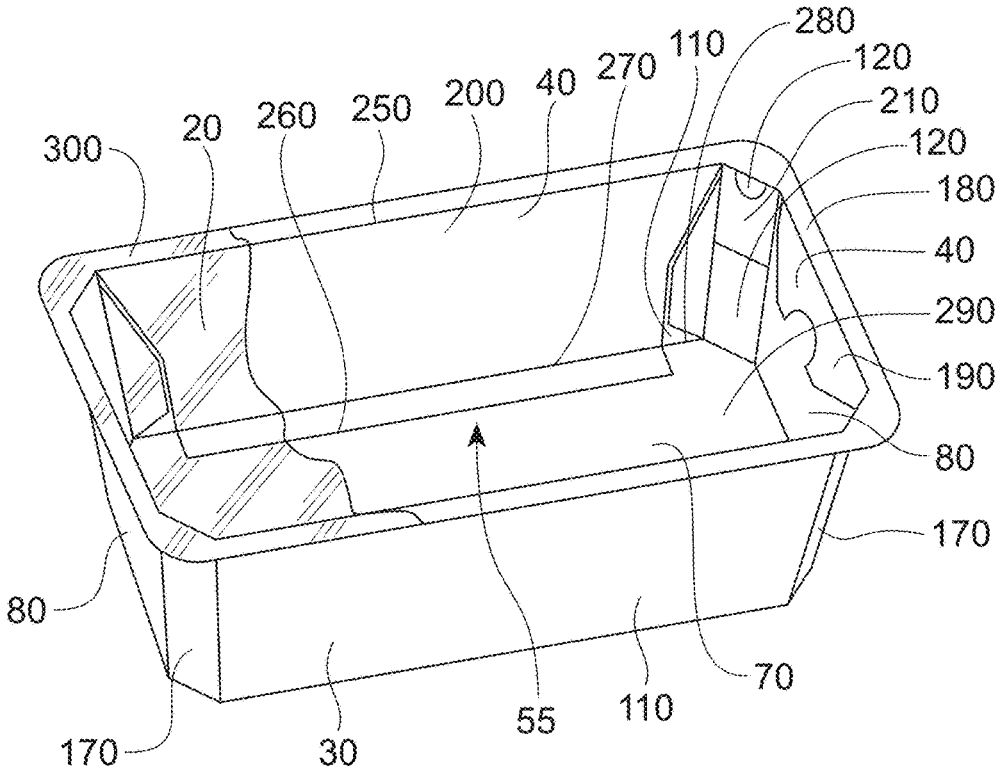
FIG. 5 is top view of an insert and cradle assembled together and the thermoplastic film is shown in partial view.

When assembled the cradle 30 and insert 40 are erected and assembled, individually each interior corner panels 210 can be in wholly facing relationship with part of one exterior corner panel 120, by way of nonlimiting example as shown in FIG. 5. That is, the entirety of the interior corner panel 120 can be facing the exterior corner panel 120. Yet, the entirety of the exterior corner panel 120 is not necessarily facing the interior corner panel 210. Interior corner panels 210 can provide for reinforcement of the juncture 170, which can be an important location of stability for container 10 since corners of the container 10 may be exposed loads and stress from the environment surrounding the container 10 or help to resist damage caused by accidental drops or stresses during transportation and handling, especially when contents of the container 10 are heavy.

Individually, for each exterior corner panel 120, one corner panel wing 160 can be in wholly facing relationship with one exterior side panel 110 and one corner panel wing 160 can be in wholly facing relationship with one exterior end panel 80. That is, the entirety of a corner panel wing 160 can be facing the exterior side panel 110 and the entirety of the other corner panel wing 160 can be facing the exterior end panel 80. Yet, the entirety of the exterior side panel 110 is not necessarily facing the corner panel wing 160 and the entirety of the exterior end panel 80 is not necessarily facing the other corner panel wing 160. Optionally and individually, more than about 80% of each corner panel wing 160 can be in facing relationship with one exterior end panel 80 or exterior side panel 110. Increasing the percentage of the corner panel wing 160 in facing relationship with the exterior end panel 80 may improve the structural stability of the container 10.

Similarly, individually each interior end panel 190 can be in wholly facing relationship with one exterior end panel 80. That is, the entirety of the interior end panel 190 can be facing the exterior end panel 80. Yet, the entirety of the exterior end panel 80 is not necessarily facing the interior end panel 190. Optionally, individually more than about 80% of each interior end panel 190 can be in facing relationship with one exterior end panel 80. The greater the amount of overlap between the interior end panel 190 and the exterior end panel 80, the more multilayer reinforcement that is provided to the ends of the container.

Individually, each interior side panel 200 can be in wholly facing relationship with one exterior side panel 110. That is, the entirety of the interior side panel 200 can be facing the exterior side panel 110. Yet the entirety of the exterior side panel 110 is not necessarily facing the interior side panel 200. Optionally, individually more than about 80% of each interior side panel 200 can be in facing relationship with one exterior side panel 110. The greater the amount of overlap between the interior side panel 200 and the exterior side panel 110, the more multilayer reinforcement that is provided to the sides of the container. Providing multiple layers of paper-based materials along the sides and ends of the container can provide for improved bending and impact strength of sides and the ends of the container 10.

Optionally and individually each interior side panel 200 can be foldably connected to the brim 180 at an interior side panel proximal end 250 and extend to an interior side panel distal end 260. Individually each interior side panel 200 can comprise an interior bottom vertex 270 between the interior side panel proximal end 250 and the interior side panel distal end 260. Individually each interior bottom vertex 270 can align with an exterior bottom vertex 280 between one exterior side panel 110 and said bottom panel 70

The bottom panel 70 can have an interior surface 290 oriented towards the top 100 of the container 10. The thermoplastic film 20 along the brim 180 has a top surface 300 oriented away from the bottom panel 70. The sheet material 50 can extend across the open end 55 and be joined to the thermoplastic film 20 along the brim 180 to define the interior space 60 between the thermoplastic film 20 and the sheet material 50.

Figure 6:
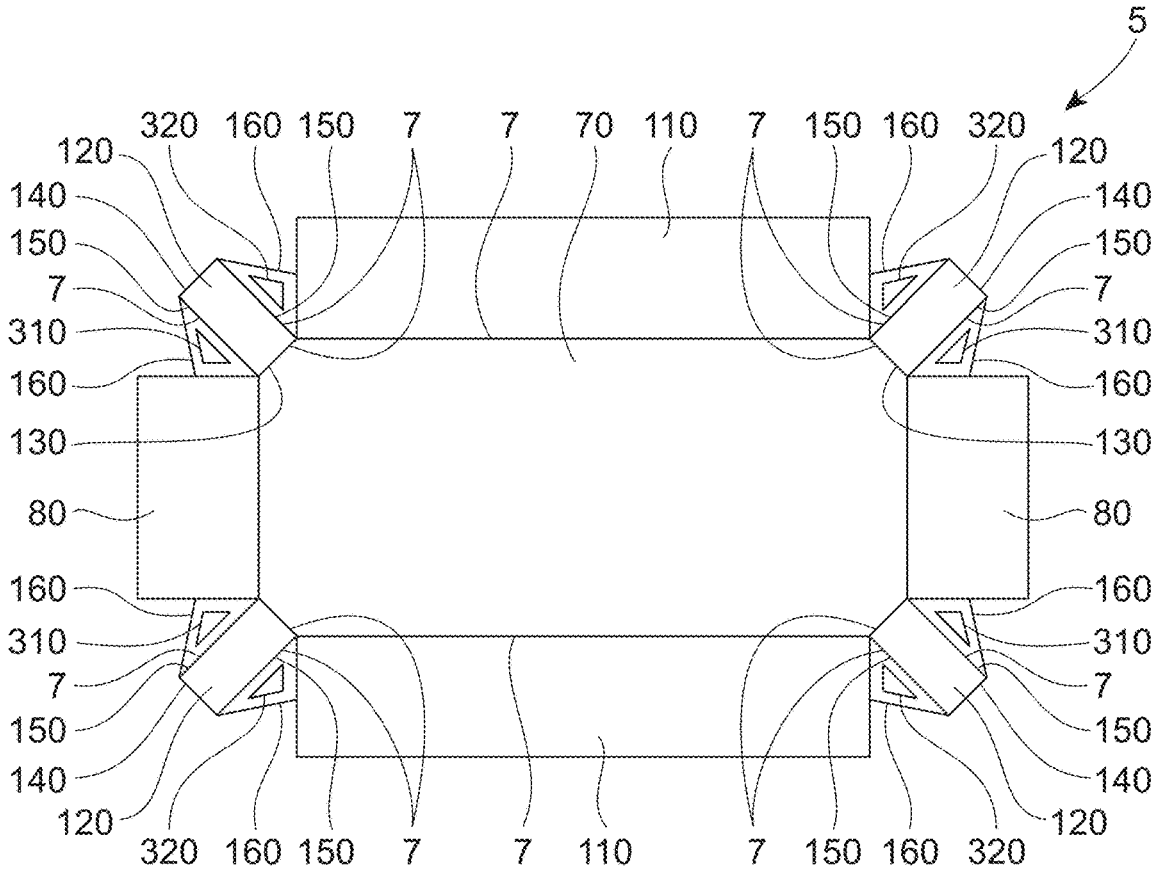
FIG. 6 is a top view of a blank of a cradle.

A variety of structures can be practical for the cradle 30. For example, individually each corner panel wing 160 that is in facing relationship with one exterior end panel 80 can have a first wing aperture 310 therethrough, by way of nonlimiting example as shown in FIG. 6. The thermoplastic film 20 can be joined to the exterior end panel 80 through the first wing apertures 310. Optionally, each corner panel wing 160 having a first wing aperture 310 has a first wing area not inclusive of the first wing aperture 310. The first wing area is a scalar quantity and is measured on the side of the corner panel wing 160 oriented towards the interior space 60 of the container 10. The first wing aperture 310 can have a first wing aperture open area that is more than 25%, optionally more than 40%, of the first wing area. The first wing aperture open area is a scalar quantity and is a measure of the area of the first wing aperture 310. Providing for such size of the first wing aperture 310 can provide for a relatively large open area through which the thermoplastic film 20 can join to the exterior end panel 80 that is presented to the first wing aperture 310 and can provide for a strong connection between the thermoplastic film 20 and the exterior end panel 80.

Similarly, individually each corner panel wing 160 in facing relationship with one exterior side panel 110 can have a second wing aperture 320 therethrough. The thermoplastic film 20 can be joined to the exterior side panel 110 through the second wing aperture 320. Optionally, each corner panel wing 160 having a second wing aperture 320 can have a second wing area not inclusive of the second wing aperture 320. The second wing area is a scalar quantity and is measured on the side of the corner panel wing 160 oriented towards the interior space 60 of the container 10. The second wing aperture 320 can have a second wing aperture open area that is more than 25%, optionally more than 40%, of the second wing area. The second wing aperture open area is a scalar quantity and is a measure of the area of the second wing aperture 320. Providing for such size of the second wing aperture 320 can provide for a relatively large open area through which the thermoplastic film 20 can join to the exterior side panel 110 that is presented to the second wing aperture 320 and can provide for a strong connection between the thermoplastic film 20 and the exterior side panel 110.

In general, by providing a sizeable first wing aperture 310 and or second wing aperture 320 the thermoplastic film 20 can have increased contact area with one or both of the exterior end panel 80 and the exterior side panel 110 to provide for additional strength of the cradle 30 at the junctures 170. The thermoplastic film 20 bonded to the exterior end panels 80 and or exterior side panels 110 through the wing apertures improve the pull out resistance of the wing from between the thermoplastic film 20 and the exterior end panel 80 or exterior side panel 110 associated with the wing. The first wing apertures 310 and second wing apertures 320 can provide for increased contact area between the thermoplastic film 20 and the cradle 30 which can improve the overall stability of the container 10. In effect, the corner panel wings 160 help to support the exterior corner panels 120 in their desired position. This is in contrast to an arrangement in which the exterior corner panel 120 does not have corner panel wings 160. Without the corner panel wings 160, the exterior corner panel 120 would be held in it desired position by only the thermoplastic film 20 joined thereto.

Figure 7:
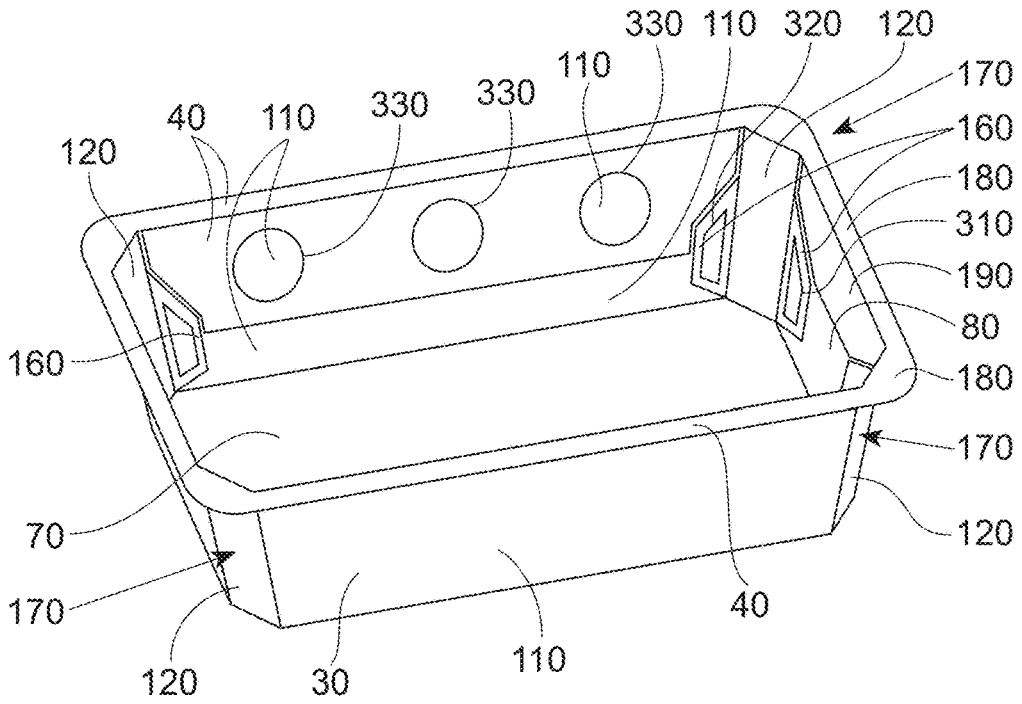
FIG. 7 is a perspective view of an insert and cradle assembled together.

Other shapes of the insert 40 are optionally contemplated. For example, individually each interior side panel 200 can have one or more interior side panel apertures 330, by way of nonlimiting example as shown in FIG. 7. The thermoplastic film 20 can be joined to the exterior side panels 110 through the interior side panel apertures 330. Such an arrangement can improve the structural integrity of the container 10 in that the thermoplastic film 20 can be engaged with the exterior side panels 110 to assist in holding the exterior side panels 110 in their erected position.

Individually, each interior side panel 200 can have an interior side panel area not inclusive of the interior side panel apertures 330. The interior side panel area is a scalar quantity and is measured on the side of the interior side panel 200 oriented towards the interior space 60 of the container. The interior side panel apertures 330 can have a side panel aperture open area that is more than 20%, optionally more than 40%, of the interior side panel area. The side panel aperture open area is a scalar quantity and is a cumulative measure of the area of the interior side panel apertures 330. Providing for such size of the interior side panel apertures 330 can provide for a relatively large open area through which the thermoplastic film 20 can join to the exterior side panel 110 that is presented to the interior side panel apertures 330 and can provide for a strong connection between the thermoplastic film 20 and the exterior end side panels 110.

Figure 8:
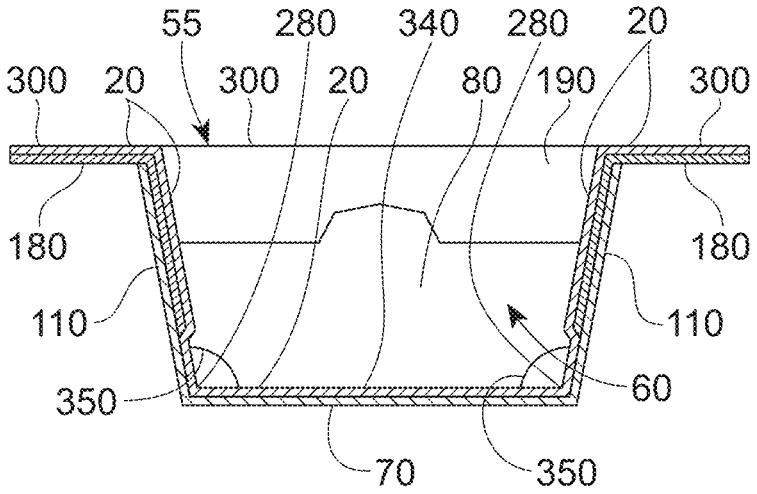
FIG. 8 is cross sectional view of an insert and cradle assembled together; the view taken towards an exterior end panel.

A cross section of a container 10 is shown in FIG. 8. The thermoplastic film 20 can have an interior surface 340 along the bottom panel 70 oriented towards the top 100 of the container 10. Along the brim 180, the thermoplastic film 20 can have a top surface 300 oriented away from the bottom panel 70. The top surface 300 can bound the open end 55. The open end 55 can have a maximum open dimension. The maximum open end dimension is a scalar quantity and is measured as the largest dimension of the open end 55. In a generally rectangularly shaped container 10, the maximum open end dimension is measured between diagonally opposite interior corners. The container 10 can have a depth measured orthogonally away from the interior surface 340 to the open end 55 that is less than 75% of the maximum open dimension. The depth of the container 10 is measured orthogonal to the bottom panel 70 from the interior surface 340 to the open end 55 bounded by the top surface 300 of the thermoplastic film 20. A container 10 configured as such is a shallow container 10. A shallow container 10 can be desirable since there is a limit to the amount of acceptable draw of the thermoplastic film 20 when the thermoplastic film 20 is thermoformed into conformance with the cradle 30 and insert 40. The depth of the container 10 can be from 5 mm to 300 mm, optionally from 20 mm to 150 mm, optionally from 20 mm to 100 mm, optionally from 40 mm to 90 mm.

Individually, each exterior side panel 110 can have an obtuse interior angle 350 to the bottom panel 70, by way of nonlimiting example as shown in FIG. 8. The obtuse interior angle 350 can be less than 180 degrees. Optionally, each exterior side panel 110 can have an interior angle 350 to the bottom panel 70 from 95 degrees to 130 degrees, optionally from 100 degrees to 125 degrees, optionally from 105 degree to about 115 degrees, optionally from 91 degrees to 100 degrees, optionally 92 degrees to 96 degrees. Exterior side panels 110 oriented as such are steeply oriented relative to the bottom panel 70 and may be easier to thermoform the thermoplastic film 20 to the cradle 30 and insert 40 without forming small holes in the thermoplastic film 20, especially compared to containers in which the side panels are perpendicular to the base. Optionally, each exterior side panel 110 can have an obtuse interior angle 350 to the bottom panel 70 from 91 degrees to 100 degrees. Optionally, each exterior side panel 110 can have an obtuse interior angle 350 to the bottom panel 70 from 92 degrees to 96 degrees. Providing an obtuse interior angle 350 to the bottom panel 70 can render fabricated container 10 that are stackable.

Figure 9:
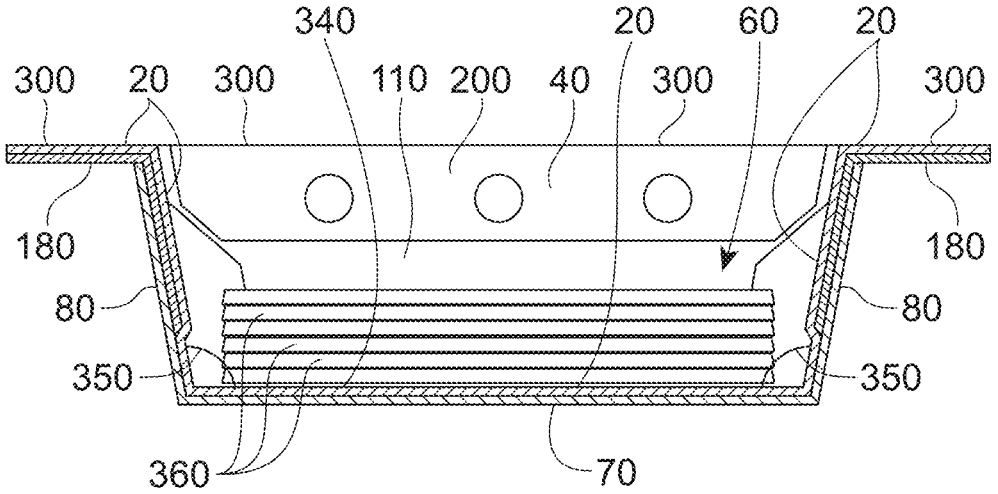
FIG. 9 is a cross sectional view of a container and the contents therein, the view taken towards an exterior side panel.

Individually, each exterior end panel 80 can have an obtuse interior angle 350 to the bottom panel 70, by way of nonlimiting example as shown in FIG. 9. The obtuse interior angle 350 can be less than 180 degrees. Optionally, each exterior end panel 80 can have an interior angle 350 to the bottom panel 70 from 95 degrees to 130 degrees, optionally from 100 degrees to 125 degrees, optionally from 105 degree to about 115 degrees, optionally from 91 degrees to 100 degrees, optionally 92 degrees to 96 degrees. Exterior end panels 80 oriented as such are steeply oriented relative to the bottom panel 70 and may be easier to thermoform the thermoplastic film 20 to the cradle 30 and insert 40 without forming small holes in the thermoplastic film 20, especially compared to containers in which the end panels are perpendicular to the bottom panel 70. Optionally, each exterior end panel 80 can have an interior angle 350 to the bottom panel 70 from 91 degrees to 100 degrees. Optionally, each exterior end panel 80 can have an interior angle 350 to the bottom panel 70 from 92 degrees to 96 degrees.

The container 10 can contain from 300 g to 2500 g of a substrate treatment product 360. The substrate treatment product 360 can be selected from the group of water soluble unit dose pouches, foams, granular products, wipes, water soluble fibrous products, moisture sensitive products, and combinations thereof. Water soluble unit dose pouches can be products such as TIDE PODS, CASCADE ACTION-PACS sold by The Procter & Gamble Company, Cincinnati, Ohio, United States of America. Wipes can be products such as SWIFFER SWEEPER WET and PAMPERS BABY WIPES sold by The Procter & Gamble Company, Cincinnati, Ohio, United States of America, or cleaning or disinfecting wipes. Water soluble fibrous products can be EC30 homecare or personal care sold by The Procter & Gamble Company, Cincinnati, Ohio, United States of America. Granular products can be products such as TIDE laundry detergent and DOWNY UNSTOPABLES sold by The Procter & Gamble Company, Cincinnati, Ohio, United States of America.

Figure 10:
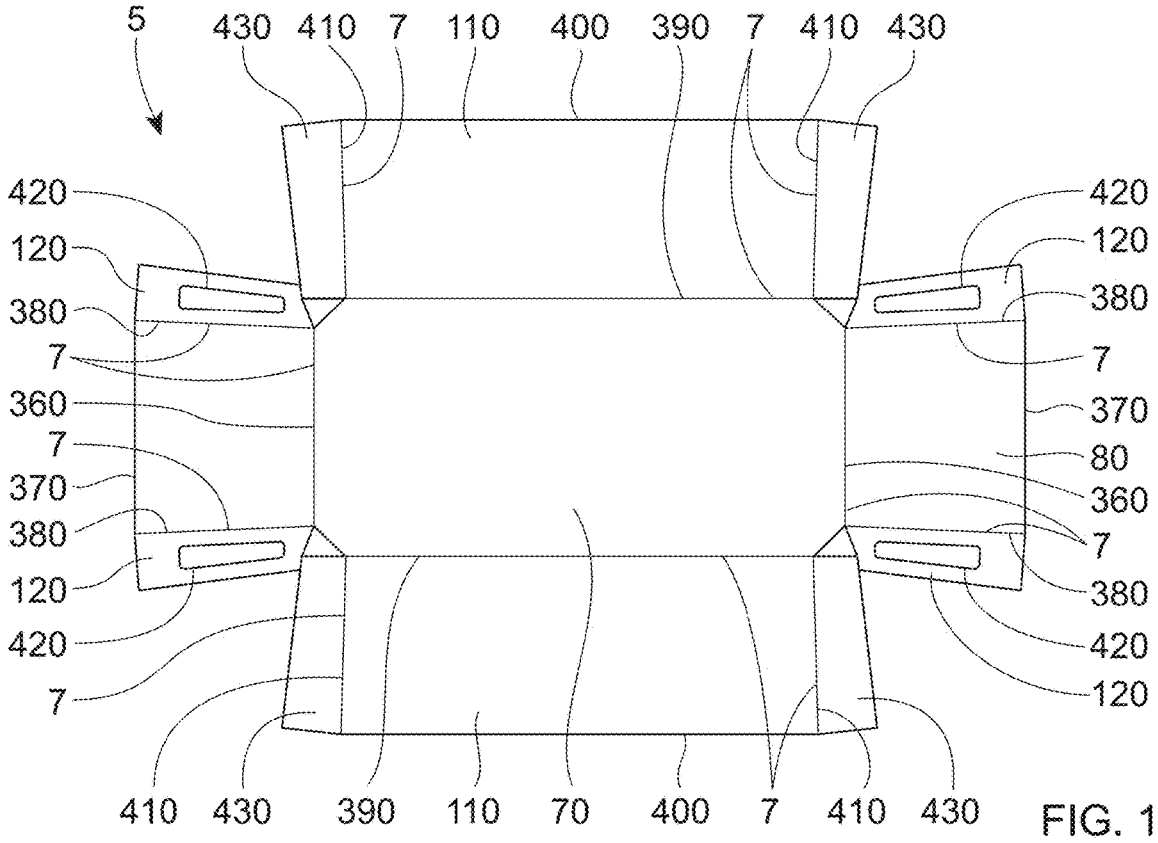
FIG. 10 is a top view of a blank of a cradle.
Figure 11:
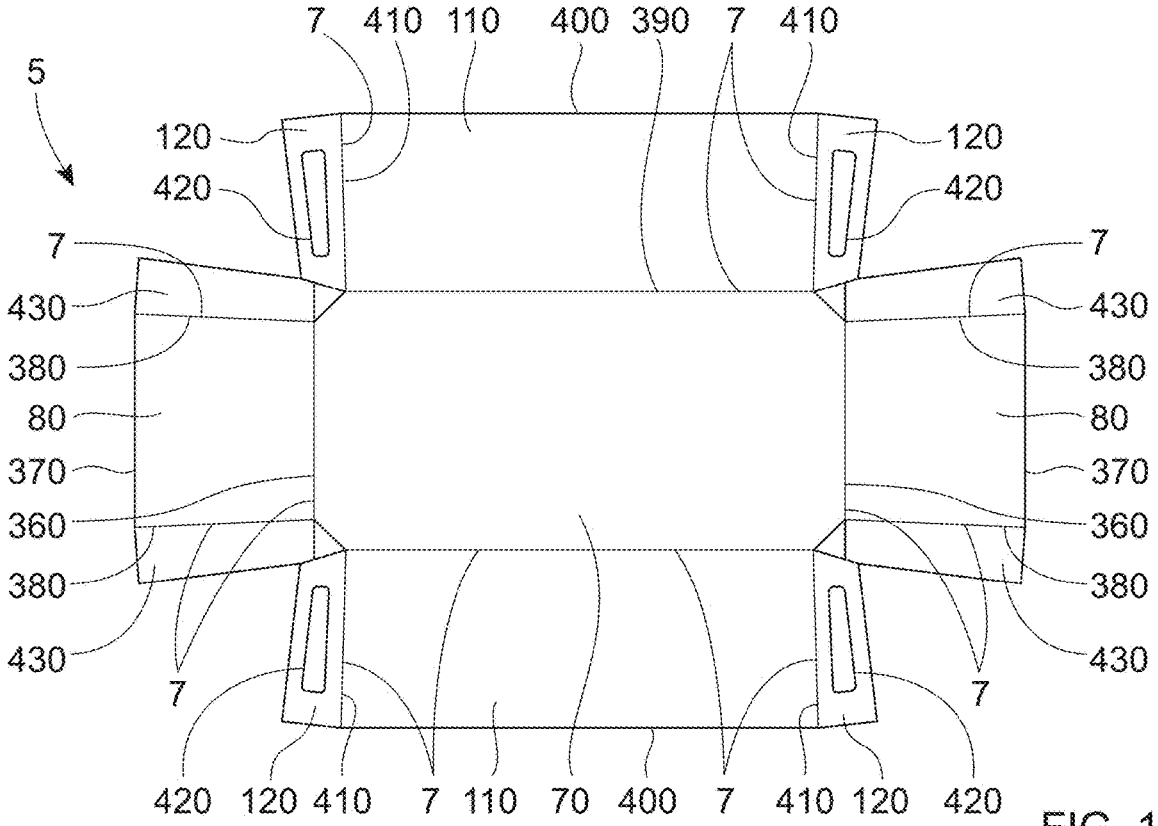
FIG. 11 is a top view of a blank of a cradle.

Other configurations for the cradle 30 can be practical for forming a container 10, by way of nonlimiting example as shown in FIGS. 10 and 11. In FIGS. 10 and 11, blanks 5 of the cradle 30 are shown. Each exterior end panel 80 can be foldably connected to the bottom panel 70 at an exterior end panel proximal end 360 and extend to an exterior end panel distal end 370 and be directed towards the top 100 of the container 10. The exterior end panels 80 can be folded about the fold lines 7 between the exterior end panels 80 and the bottom panel 70 towards the top 100 of the container 10 to direct the exterior end panels 80 towards the top 100 of the container 10. Each exterior end panel 80 can comprise opposing exterior end panel lateral edges 380 extending from the exterior end panel proximal end 360 to the exterior end panel distal end 370.

Each exterior side panel 110 can be foldably connected to the bottom panel 70 at an exterior side panel proximal end 390 and extend to an exterior side panel distal end 400 and be directed towards the top 100 of the container. The exterior side panels 110 can be folded about the fold lines 7 between the exterior side panels 110 and the bottom panel 70 towards the top 100 of the container 10 to direct the exterior side panels 110 towards the top 100 of the container 10. Each exterior side panel 110 can comprise opposing exterior side panel lateral edges 410 extending from the exterior side panel proximal end 390 to the exterior side panel distal end 400.

The cradle 30 can comprise four exterior corner panels 120. Individually each exterior corner panel 120 can be foldably connected to one exterior end panel lateral edge 380 or one exterior side panel lateral edge 410. Each exterior corner panel 120 can have a corner panel aperture 420 therethrough. The cradle 30 can further comprise four corner backing panels 430. Individually each corner backing panel 430 can be foldably connected to one exterior end panel lateral edge 380 or one exterior side panel lateral edge 410.

Figure 12:
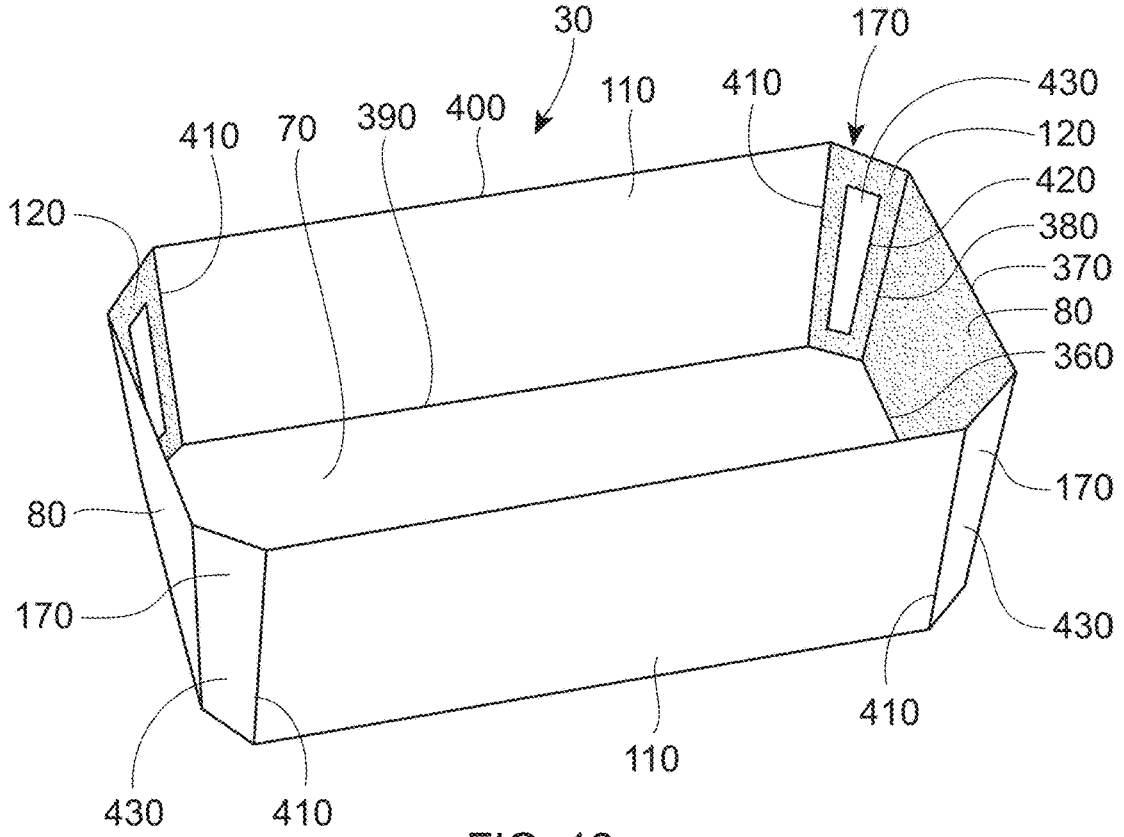
FIG. 12 is an erected cradle formed from a cradle like that shown in FIG. 10.
Figure 13:
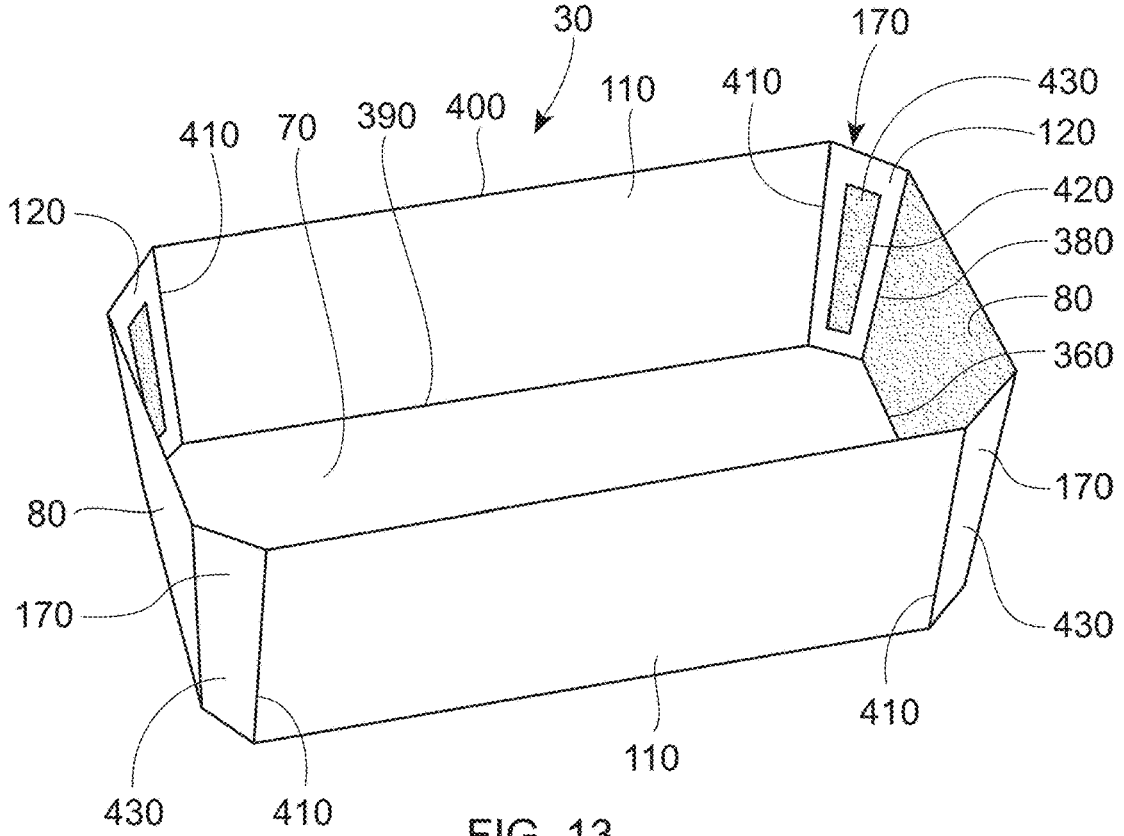
FIG. 13 is an erected cradle formed from a cradle like that shown in FIG. 11.

The blanks of the cradles 30 shown in FIGS. 10 and 11 can be erected to be in an arrangement as shown in FIGS. 12 and 13, respectively. In FIG. 12, the interior facing surfaces of the end panel 80 and the interior facing surfaces of the exterior corner panels 120 are illustrated with stippling. In FIG. 13, the interior facing surface of the end panel 80 and the corner backing panel 430 are illustrated with stippling. The exterior corner panels 120 and corner backing panels 430 form the junctures 170. The junctures 170 proved for a gradual shape transition in the erected cradle 30 between the exterior end panels 80 and exterior side panels 110 and can help improve the ability to thermoform the thermoplastic film 20 without defects being formed, as described previously. Individually each corner backing panel 430 can be joined to the thermoplastic film 20 through the corner panel aperture 420. Providing for the thermoplastic film 20 being joined to the corner backing panel 430 through the corner panel aperture 420 can provide strength at the junctures 170.

And the corner backing panels 430 can provide for improved impact resistance at the junctures 170.

Figure 14:
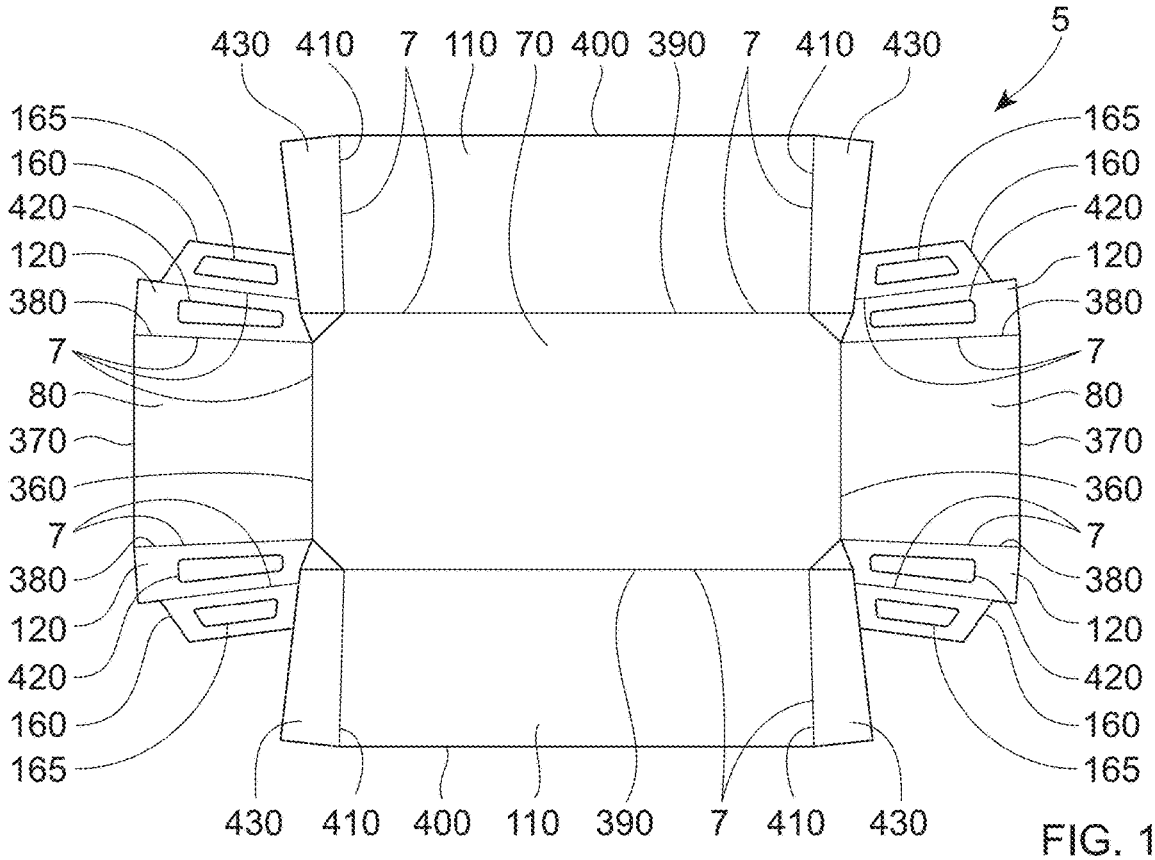
FIG. 14 is a top view of a blank of a cradle.

Individually each exterior corner panel 120 can be foldably connected to one exterior end panel lateral edge 380, by way of nonlimiting example as shown in FIG. 14. Individually each exterior corner panel 120 can have a corner panel wing 160 foldably connected thereto. Individually each corner panel wing 160 can be in at least partially facing relationship with one exterior side panel 110 and have a wing aperture 165 therethrough. The thermoplastic film 20 can be joined to the exterior side panel 110 through the wing apertures 165. Such an arrangement provides an additional location for the thermoplastic film 20 to be joined to the exterior side panel 110 beyond being attached to a corner backing panel 430 that is foldably connected to the exterior side panel 110.

Figure 15:
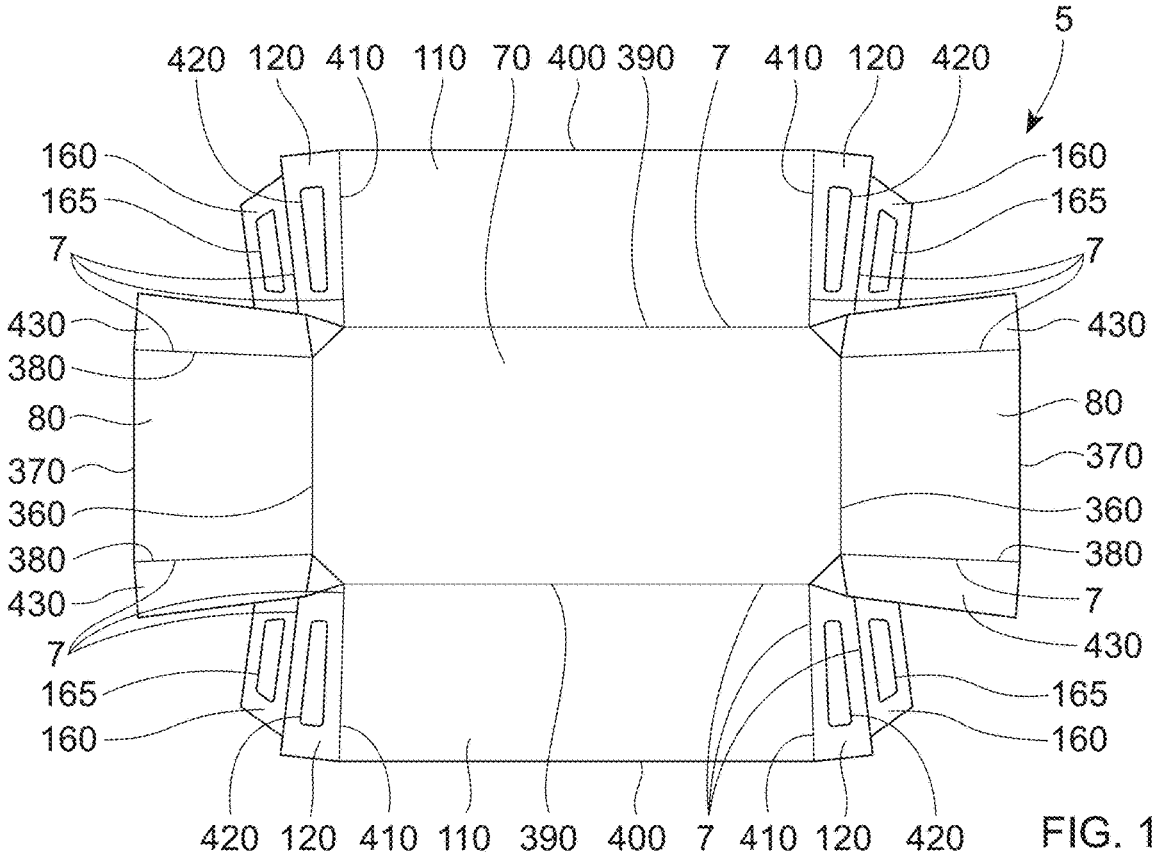
FIG. 15 is top view of a blank of a cradle.

Individually each exterior corner panel 120 can be foldably connected to one exterior side panel lateral edge 410, by way of nonlimiting example as shown in FIG. 15. Individually each exterior corner panel 120 can have a corner panel wing 160 foldably connected thereto. Individually each corner panel wing 160 can be in at least partial facing relationship with one exterior end panel 80 and have a wing aperture 165 therethrough. The thermoplastic film 20 can be joined to the exterior end panels 80 through the wing apertures 165. Such an arrangement provides an additional location for the thermoplastic film 20 to be joined to the exterior end panel 80 beyond being attached to a corner backing panel 430 that foldably connected to the exterior end panel 80.

Figure 16:
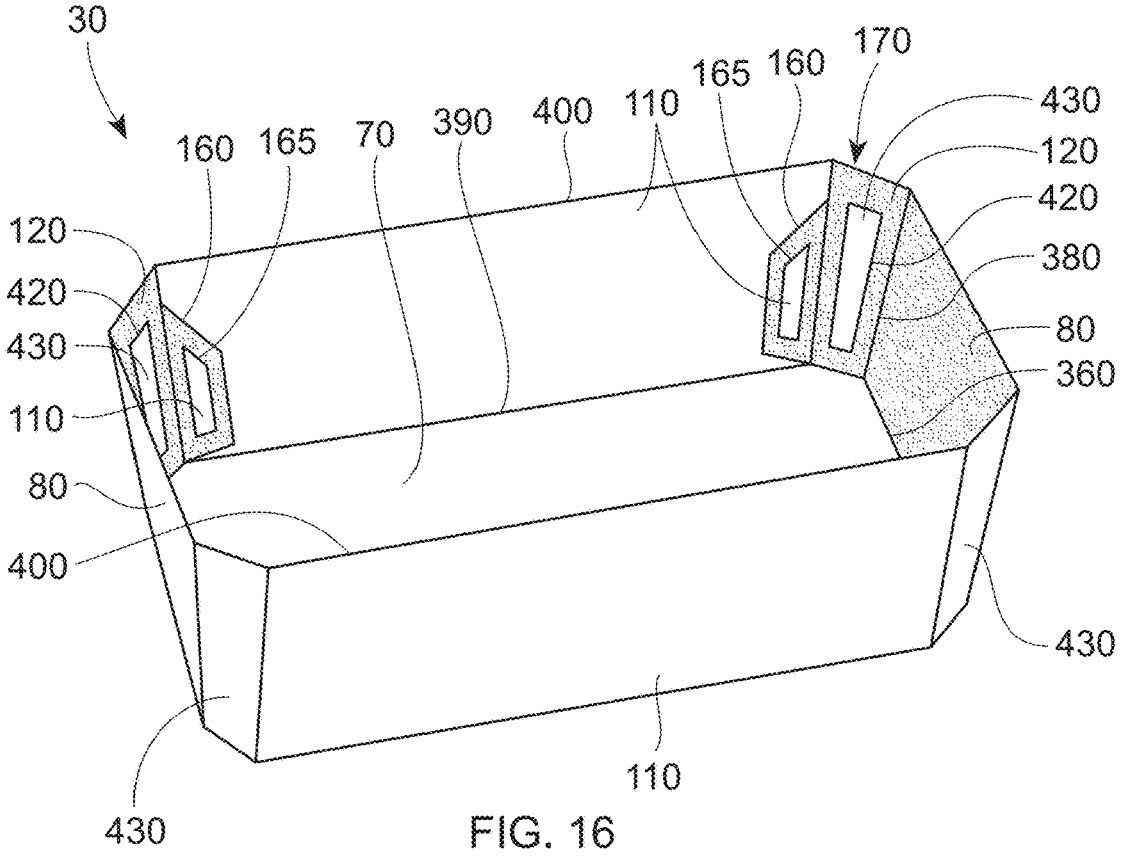
FIG. 16 is an erected cradle formed from a cradle like that shown in FIG. 14.
Figure 17:
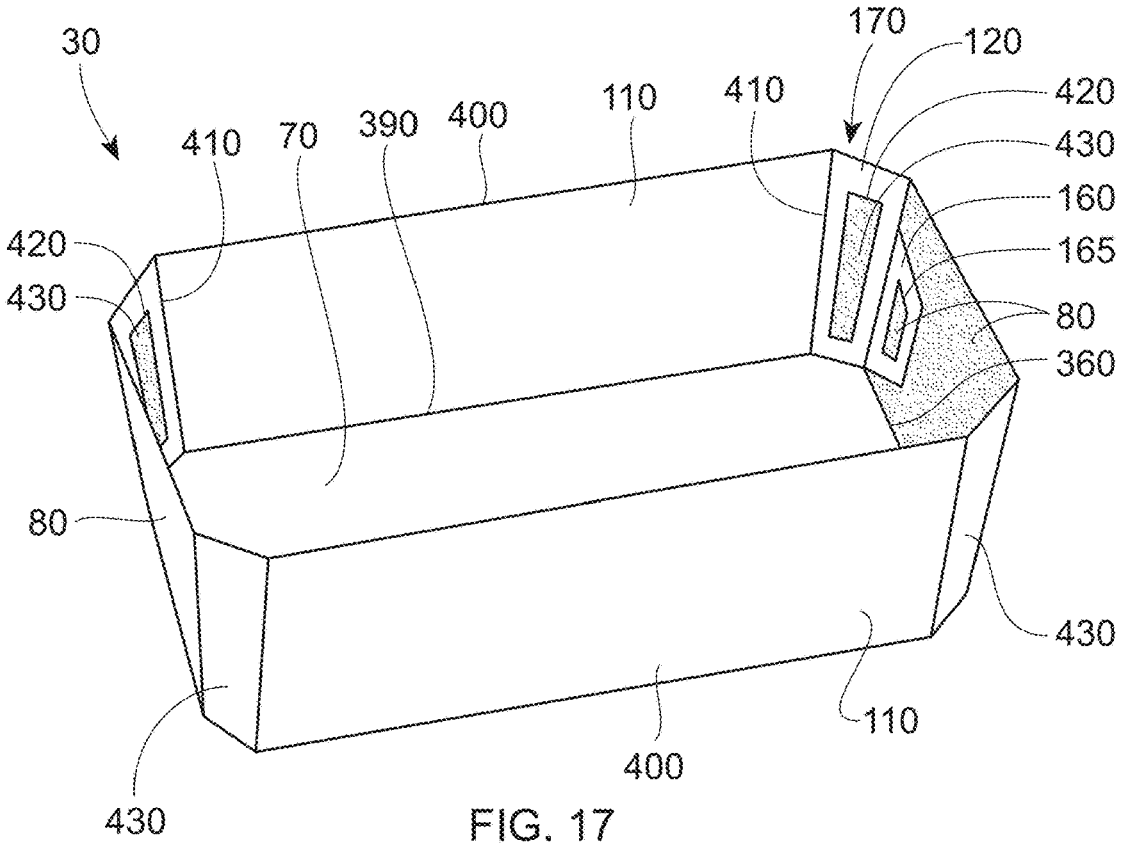
FIG. 17 is an erected cradle formed from a cradle like that shown in FIG. 15.

The blanks of the cradles 30 shown in FIGS. 14 and 15 can be erected to be in an arrangement as shown in FIGS. 16 and 17, respectively. In FIG. 16, the interior facing surface of the end panel 80, the interior facing surfaces of the exterior corner panels 120, and the interior facing surfaces of the corner panel wings 160 are illustrated with stippling. In FIG. 17, the interior facing surface of the end panel 80 and the corner backing panels 430 are illustrated with stippling.

Figure 18:
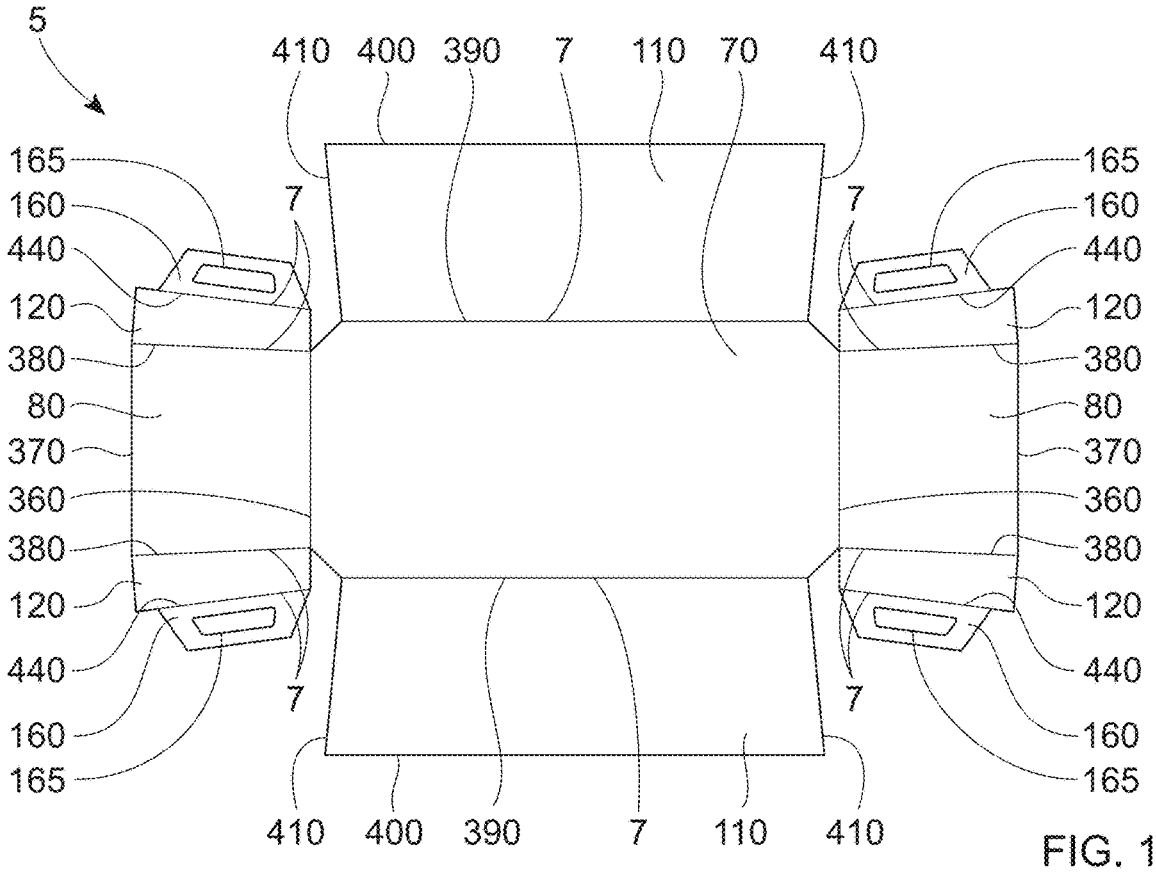
FIG. 18 is a top view of a blank of a cradle.
Figure 19:
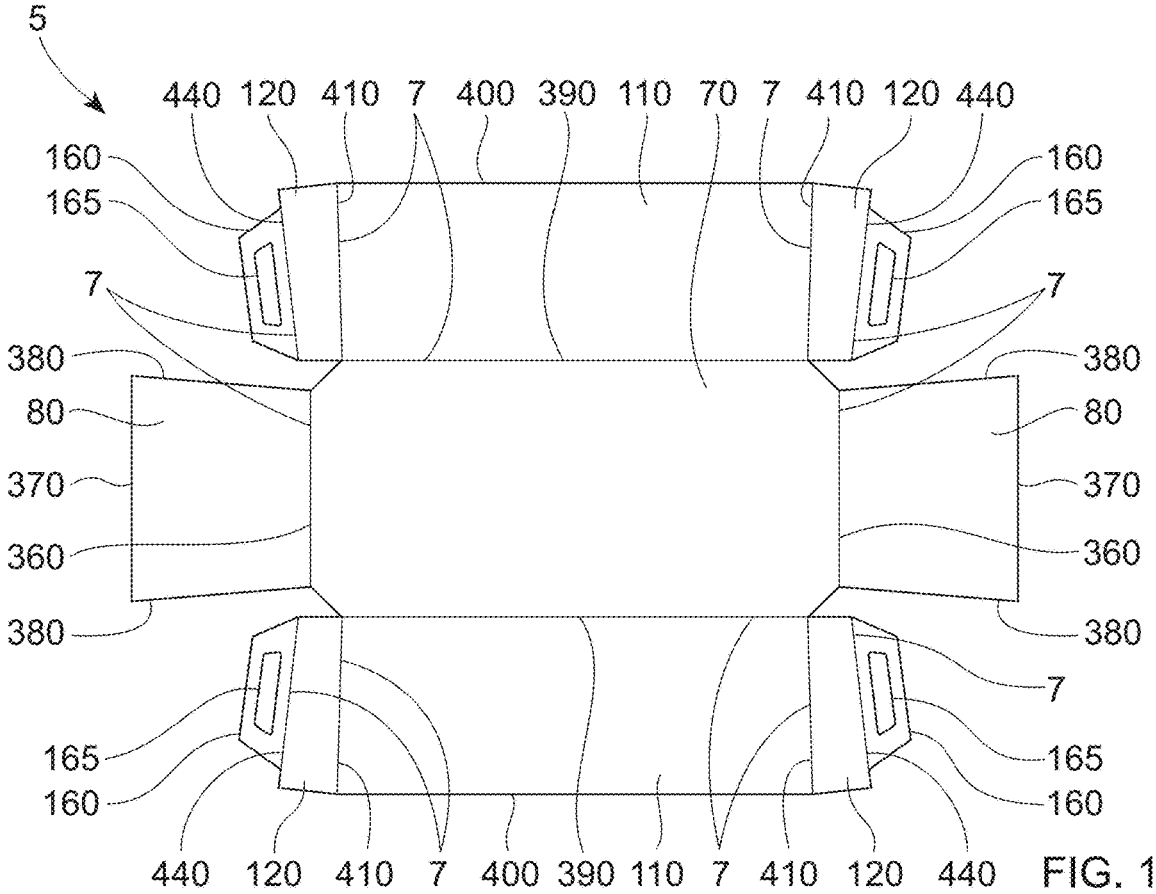
FIG. 19 is top view of a blank of a cradle.

Blanks of other practical cradles 30 are shown in FIGS. 18 and 19. As shown in FIGS. 18 and 19, each exterior corner panel 120 can be foldably connected to one exterior end panel lateral edge 380 (FIG. 18) or one exterior side panel lateral edge 410 (FIG. 19). Individually each exterior corner panel 120 can have a corner panel wing 160 foldably connected thereto. Each exterior corner panel 120 can extend to a corner panel vertex 440 from which a corner panel wing 160 is foldably connected thereto. Individually each corner panel wing 160 can be in at least partial facing relationship with one exterior end panel 80 or one exterior side panel 110. The thermoplastic film 20 can be joined to the brim 180, the bottom panel 70, the interior end panels 190, the interior side panels 200, the exterior end panels 80, the exterior side panels 110, the exterior corner panels 120, and the corner panel wings 160.

Optionally, each corner panel wing 160 can have a wing aperture 165 therethrough. The thermoplastic film 20 can be joined to the exterior end panel 80 or the exterior side panel 110 through the wing apertures 165. Optionally, individually each corner panel wing 160 can have a corner panel wing area not inclusive of the wing aperture 165 and the wing aperture 165 can have a wing aperture open area that is more than 25%, optionally more than 40%, of the corner panel wing area. The corner panel wing area is a scalar quantity and is measured on the corner panel wing 160 oriented towards the interior space 60 of the container 10. The wing aperture open area is a scalar quantity and is a measure of the area of the wing aperture 165. Providing for such size of the wing aperture 165 can provide for a relatively large open area through which the thermoplastic film 20 can join to the exterior end panel 80 or exterior side panel 110 that is presented to the wing aperture 165 and can provide for a strong connection between the thermoplastic film 20 and the exterior end panel 80 or exterior side panel 110.

Figure 20:
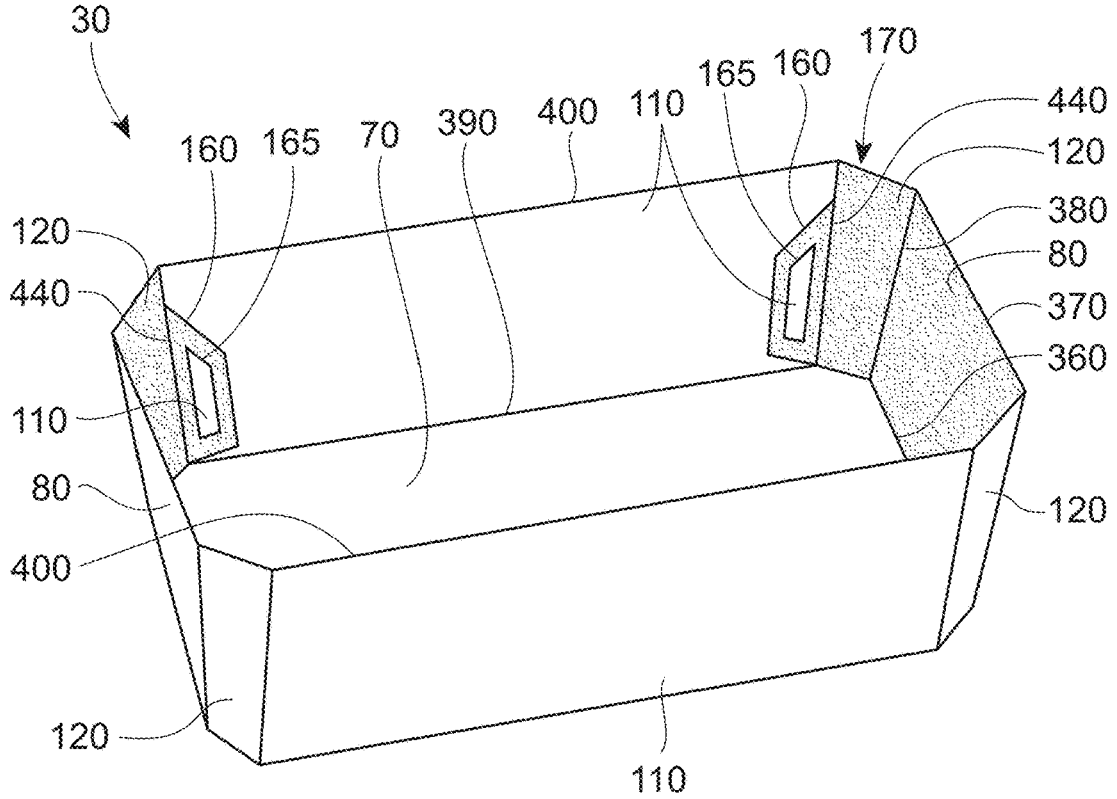
FIG. 20 is an erected cradle formed from a cradle like that shown in FIG. 18.
Figure 21:
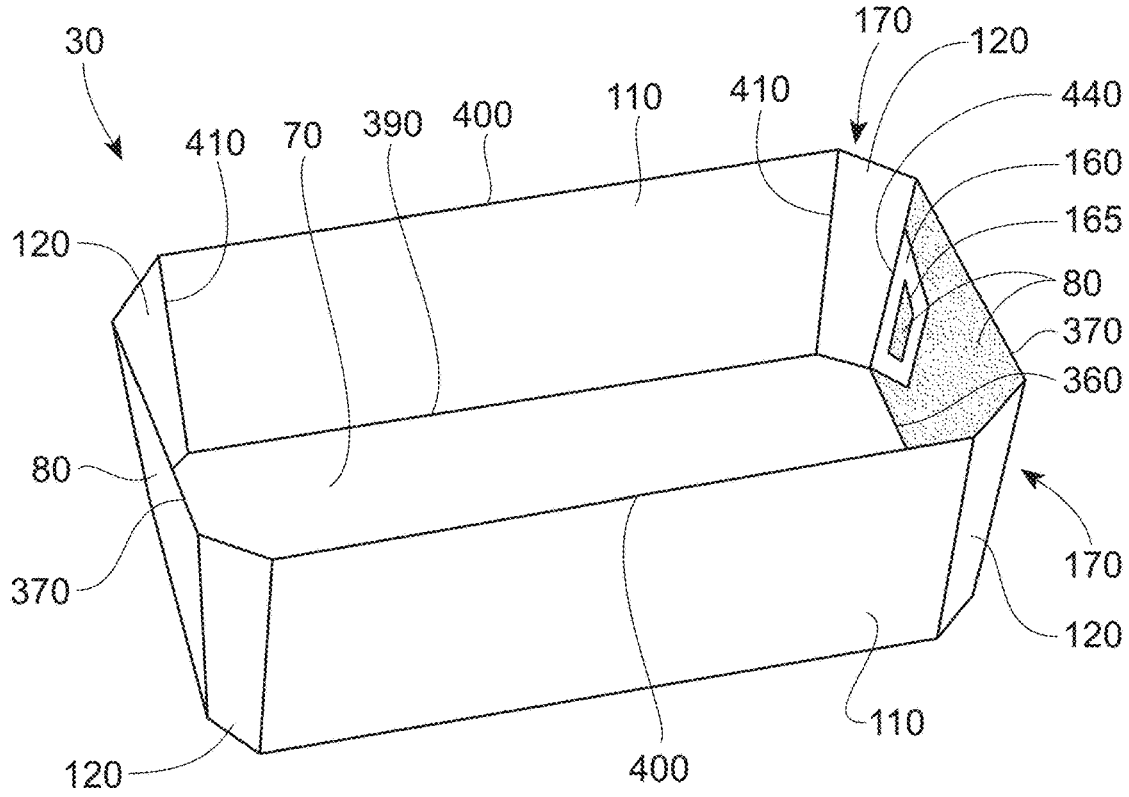
FIG. 21 is an erected cradle formed from a cradle like that shown in FIG. 19.

The blanks of the cradles 30 shown in FIGS. 18 and 19 can be erected to be in an arrangement as shown in FIGS. 20 and 21, respectively. In FIG. 20, the interior facing surface of the end panel 80, the interior facing surfaces of the exterior corner panels 120, and the interior facing surfaces of the corner panel wings 160 are illustrated with stippling. In FIG. 21, the interior facing surface of the end panel 80 is illustrated with stippling.

The insert 40 described previously can be assembled with any of the cradles 30 described herein.

Paper-Based Materials

The paper-based materials can be paperboard and corrugate cardboard and combinations thereof. Corrugate cardboard can comprise flutes between two layers of paperboard. Paper-based materials are materials that are comprised of more than 50%, optionally more than 70%, optionally more than 90%, optionally more than 95%, by weight cellulose fibers. Fibrous cellulose material can be virgin, recycled, or a mixture thereof. The cradle 30 and the insert 40 can contain recycled cellulose fibers. Optionally, individually each of the cradle 30 and insert 40 can comprise from 20% to 100%, optionally from 40% to 100% optionally from 80% to 100%, by weight recycled cellulose fibers.

Cellulose materials may be obtained from hardwood, softwood, or other natural renewable resources for fibers. Fibrous cellulose material can be obtained from bamboo, wheat straw, bulrush, corn, rice husk, sugar cane, grass fiber, or from recycled paper and paperboard. Paper-based materials can include other constituents including but not limited to inks, colorants, protective varnishes, surface enhancement coatings, barrier coating, preservative, recycled fiber materials, plasticizers, ultra violet light stabilizers, oxygen barriers, perfume barriers, moisture barriers, and combinations thereof. The cradle 30 and or insert 40 may include printing on the exterior and or interior of the container 10.

The paper-based materials can be a laminate of paperboard and lining material or corrugate card board and a lining material. The lining material can be, by way of nonlimiting example, polyethylene, low density polyethylene, polyethylene terephthalate, polypropylene polyvinylalcohol, and combinations thereof. The lining material can be, by way of nonlimiting example, a copolymer from an ethylene starting monomer and vinyl alcohol, or EVOH. The lining material can be a barrier material, such as metallized polyethylene terephthalate or biaxially oriented polypropylene and combinations thereof. The lining material can have a thickness from 10 microns to 150 microns, optionally from 10 microns to 60 microns, optionally from 10 microns to 35 microns. Linings of wax, clay, starch, kaolin, polyethylene terephthalate, polypropylene, polylactic acid, silicates, ethylene vinyl alcohol, polyvinyl alcohol, and other natural and or biodegradable coatings that adequately provide a barrier can be useful.

Paperboard can be a single ply of paperboard or a laminate of two or more plies of paperboard joined to one another by applying one or a combination of heat, pressure, and adhesive. Paperboard can have a basis weight greater than 250 g/m$^2$, optionally from about 250 g/m$^2$ to about 800 g/m$^2$. Paperboard can be coated with a substance, by way of nonlimiting example liquid repellants, varnishes, or other coatings, so that the material is printable, to protect the contents of the container 10, or protect the paperboard materials of the container 10 from the contents in the event the exterior of the container 10 is splashed with liquid. Paperboard can have a thickness from 200 microns to 5000 microns, optionally from 200 microns to 2000 microns, optionally from 500 microns to 1000 microns.

Forming the Container

To form the container 10 the cradle 30 can be erected. The cradle 30 can be erected by placing the blank of cradle 30 over a mold. The edges of the mold have a shape such as the blank of the cradle 30 is pushed into the mold, the panels and or wings are moved into the intended position. The blank of the cradle 30 can be pushed into the mold by a die. As the blank of the cradle 30 is pushed into the mold the flat blank of the cradle 30 is transformed into the three dimensional shape of the cradle 30 by bending the exterior end panels 80 and exterior side panels 110 towards what ultimately becomes the top 100 of the container 10. Likewise, the blank of the insert 40 can be placed over the same mold and conformed to shape of the cradle 30 which is conformed to the shape of the mold. The mold can be provided with a rugose interior surface and have one or more vacuum ports through which vacuum within the mold can be generated or pressure released once the thermoplastic film 20 is placed over the mold. The thermoplastic film 20 can be placed over the open end 55 of the container and extend out over the brim 180. The thermoplastic film 20 can be sealed to the mold and or brim 180. The thermoplastic film 20 can be heated to or above its moldable temperature and can be thermoformed to conform with the insert 40 and cradle 30. The thermoplastic film 20 can be heated by passing the thermoplastic film 20 through an oven. Optionally, the thermoplastic film 20 can be heated by exposing one or both sides of the thermoplastic film 20 to infrared heaters or other radiant heaters. Heat may be applied in different quantities to different parts of the thermoplastic film 20 to promote the desired distribution of the thermoplastic film 20 during thermoforming.

The thermoplastic film 20 can be thermoformed by vacuum thermoforming, pressure thermoforming, or thermoformed by pressing on the heated thermoplastic film 20 with a die. The thermoformed thermoplastic film 20 can be cooled, actively or passively, and become joined to the brim 180, said bottom panel 70, the interior end panels 190, the interior side panels 200, the exterior end panels 80, the exterior side panels 110, and the exterior corner panels 120. The formed containers 10 can be stacked in a nesting relationship for temporary storage or transportation to a filling site. The contents of the container 10 can then be placed in the interior space 60 of the container 10 and the sheet material 50 can be placed over the open end 55 and joined to the top surface 300 of the thermoplastic film 20 along the brim 180 to enclose the contents of the container 10 in the interior space 60 of the container 10. The containers 10 can be filled at the same facility in which the container 10 is fabricated or filled at a different facility.

Thermoplastic Film

The thermoplastic film 20 can be a plastic polymer material that becomes pliable or moldable at an elevated temperature and solidifies upon cooling. The thermoplastic film 20 can be a film of polyvinylchloride, acrylonitrile butadiene styrene, polyethylene, low density polyethylene, high density polyethylene, polystyrene, high impact polystyrene, polycarbonate, polyamide, polypropylene, polyethylene terephthalate, and combinations thereof. The thermoplastic film 20 can be a laminate of films. The thermoplastic film 20 can include an EVOH ply to improve the barrier characteristics of the thermoplastic film 20. The thermoplastic film 20 can be biobased material, such, but not limited to, polylactic acid. Other compostable, biodegradable, thermoplastic materials are suitable to constitute the thermoplastic film 20.

The thermoplastic film 20 prior to being thermoformed into conformance with the cradle 30 and the insert 40 can have a thickness from 20 micron to 1000 microns, optionally from 30 microns to 500 microns, optionally from 40 microns to 250 microns, optionally from 40 microns to 80 microns, optionally from 100 microns to 120 microns.

An Example is Below

A. A container (10) comprising:

a paper-based cradle (30) comprising:

a bottom panel (70);

a pair of opposing exterior end panels (80), wherein each exterior end panel is foldably connected to said bottom panel at an exterior end panel proximal end (360) and extends to an exterior end panel distal end (370) and is directed towards a top (100) of said container, and wherein each exterior end panel comprises opposing exterior end panel lateral edges (380) extending from said exterior end panel proximal end to said exterior end panel distal end;

a pair of opposing exterior side panels (110), wherein each exterior side panel is foldably connected to said bottom panel at an exterior side panel proximal end (390) and extends to an exterior side panel distal end (400) and is directed towards said top of said container, and wherein each exterior side panel comprises opposing exterior side panel lateral edges (410) extending from said exterior side panel proximal end to said exterior side panel distal end; and four exterior corner panels (120), wherein each corner panel is foldably connected to one said exterior end panel lateral edge or one said exterior side panel lateral edge, wherein individually each exterior corner panel has a corner panel wing (160) foldably connected thereto;

wherein individually each corner panel wing is in at least partial facing relationship with one said exterior end panel or one said exterior side panel;

a paper-based insert (40) partially inboard of said cradle and comprising:

a continuous brim (180);

a pair of interior end panels (190) foldably connected to said brim, wherein each said interior end panel is directed towards a bottom (90) of said container and is in at least partial facing relationship with one said exterior end panel; and a pair of interior side panels (200) foldably connected to said brim, wherein each said interior side panel is directed towards said bottom and is in at least partial facing relationship with one said exterior side panel; and a thermoplastic film (20) inboard of said insert and joined to said brim, said bottom panel, said interior end panels, said interior side panels, said exterior end panels, said exterior side panels, said exterior corner panels, and said corner panel wings.

B. The container according to Paragraph A:

wherein each corner panel wing has a wing aperture (130) therethrough; and wherein said thermoplastic film is joined to said exterior end panel or said exterior side panel through said wing aperture.

C. The container according to Paragraph B, wherein individually each said corner panel wing has a corner panel wing area not inclusive of said wing aperture and said wing aperture has a wing aperture open area that is more than 25% of said corner panel wing area.

D. The container according to any of Paragraphs A to C:

wherein individually each said interior side panel has one or more interior side panel apertures (330) therethrough; and wherein said thermoplastic film is joined to said exterior side panels through said interior side panel apertures.

E. The container according to Paragraph D, wherein individually each said interior side panel has an interior side panel area not inclusive of said interior side panel apertures and said interior side panel apertures have a side panel aperture open area that is more than 20% of said interior side panel area.

F. The container according to any of Paragraphs A to E further comprising:

four interior corner panels (210) foldably connected to said brim;

wherein individually each interior corner panel is in at least partial facing relationship with part of one said exterior corner panel.

G. The container according to Claim F:

wherein individually each interior corner panel is in wholly facing relationship with part of one exterior corner panel.

H. The container according to any of Paragraphs A to G:

wherein individually each interior end panel is in wholly facing relationship with one exterior end panel.

I. The container according to any of Paragraphs A to H:

wherein individually each interior side panel is in wholly facing relationship with one exterior side panel.

J. The container according to any of Paragraphs A to I:

wherein individually each said interior end panel is foldably connected to said brim at an interior end panel proximal end (220) and extends to an interior end panel distal end (230); and wherein each interior end panel distal end includes a concave end profile (240).

K. The container according to any of Paragraphs A to J:

wherein individually each interior side panel is foldably connected to said brim at an interior side panel proximal end (250) and extends to an interior side panel distal end (260);

wherein individually each interior side panel comprises an interior bottom vertex (270) between said interior side panel proximal end and said interior side panel distal end; and wherein individually each interior bottom vertex aligns with an exterior bottom vertex (280) between one exterior side panel and said bottom panel.

L. The container according to any of Paragraphs A to K, wherein individually more than about 80% of each interior side panel is in facing relationship with one exterior side panel.

M. The container according to any of Paragraphs A to L, wherein individually more than about 80% of each interior end panel is in facing relationship with one exterior end panel.

N. The container according to any of Paragraphs A to M:

wherein said thermoplastic film has interior surface (340) along said bottom panel oriented towards said top;

wherein said thermoplastic film along said brim has top surface (300) oriented away from said bottom panel;

wherein said top surface bounds an open end (55);

wherein said open end has a maximum open dimension; and wherein said container has a depth measured orthogonally away from said interior surface to said open end that is less than 75% of said maximum open dimension.

O. The container according to any of Paragraphs A to N, wherein individually each said exterior side panel has an obtuse interior angle (350) to said bottom panel.

P. The container according to any of Paragraphs A to O, wherein individually each said exterior end panel has an obtuse interior angle (350) to said bottom panel.

Q. The container according to any of Paragraphs A to P:

wherein said thermoplastic film along said brim has a top surface (300) oriented away from said bottom panel and bounds an open end (55); and wherein a sheet material (50) extends across said open end and is joined to said thermoplastic film along said brim to define an interior space (60) between said thermoplastic film and said sheet material.

R. The container according to any of Paragraphs A to Q wherein said container contains from 300 g to 2500 g of a substrate treatment product.

S. The container according to any of Paragraphs A to R, wherein said container contains substrate treatment products selected from the group of water soluble unit dose pouches, foams, wipes, water soluble fibrous products, moisture sensitive products, and combinations thereof.

T. The container according to any of Paragraphs A to S, where said container is devoid of adhesive between parts of said cradle that are in facing relationship with one another and is devoid of adhesive between parts of said insert in facing relationship with parts of said cradle.

U. The container according to any of Paragraphs A to T, wherein together said cradle and said insert contain recycled cellulose fibers.

V. The container according to any of Paragraphs A to U, wherein individually each of said cradle and said insert comprise more than about 50% by weight recycled cellulose fibers.

W. The container according to any of Paragraphs A to V, wherein said cradle, said insert, and said thermoplastic film have a combined weight, wherein cellulose fibers constitute more than 80% of said combined weight.

X. The container according to any of Paragraphs A to W:

wherein said thermoplastic film has interior surface (340) along said bottom panel oriented towards said top;

wherein said thermoplastic film along said brim has top surface (300) oriented away from said bottom panel;

wherein said top surface bounds an open end (55);

wherein said open end has a maximum open dimension; and wherein said container has a depth measured orthogonally away from said interior surface to said open end that is from 20 mm to 150 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:

a paper-based cradle comprising:

a bottom panel;

a pair of opposing exterior end panels, wherein each exterior end panel is foldably connected to said bottom panel at an exterior end panel proximal end and extends to an exterior end panel distal end and is directed towards a top of said container, and wherein each exterior end panel comprises opposing exterior end panel lateral edges extending from said exterior end panel proximal end to said exterior end panel distal end;

a pair of opposing exterior side panels, wherein each exterior side panel is foldably connected to said bottom panel at an exterior side panel proximal end and extends to an exterior side panel distal end and is directed towards said top of said container, and wherein each exterior side panel comprises opposing exterior side panel lateral edges extending from said exterior side panel proximal end to said exterior side panel distal end; and four exterior corner panels, wherein each corner panel is foldably connected to one said exterior end panel lateral edge or one said exterior side panel lateral edge, wherein individually each exterior corner panel has a corner panel wing foldably connected thereto, and wherein each corner panel wing has a wing aperture therethrough;

wherein individually each corner panel wing is in at least partial facing relationship with one said exterior end panel or one said exterior side panel;

a paper-based insert partially inboard of said cradle and comprising:

a continuous brim;

a pair of interior end panels foldably connected to said brim, wherein each said interior end panel is directed towards a bottom of said container and is in at least partial facing relationship with one said exterior end panel; and a pair of interior side panels foldably connected to said brim, wherein each said interior side panel is directed towards said bottom and is in at least partial facing relationship with one said exterior side panel; and a thermoplastic film inboard of said insert and joined to said brim, said bottom panel, said interior end panels, said interior side panels, said exterior end panels, said exterior side panels, said exterior corner panels, and said corner panel wings;

wherein said thermoplastic film is joined to said exterior end panel or said exterior side panel through said wing aperture.

2. The container according to claim 1, wherein individually each said corner panel wing has a corner panel wing area not inclusive of said wing aperture and said wing aperture has a wing aperture open area that is more than 25% of said corner panel wing area.

3. The container according to claim 1:

wherein individually each said interior side panel has one or more interior side panel apertures therethrough; and wherein said thermoplastic film is joined to said exterior side panels through said interior side panel apertures.

4. The container according to claim 3, wherein individually each said interior side panel has an interior side panel area not inclusive of said interior side panel apertures and said interior side panel apertures have a side panel aperture open area that is more than 20% of said interior side panel area.

5. The container according to claim 1 further comprising:

four interior corner panels foldably connected to said brim;

wherein individually each interior corner panel is in at least partial facing relationship with part of one said exterior corner panel.

6. The container according to claim 5:

wherein individually each interior corner panel is in wholly facing relationship with part of one exterior corner panel.

7. The container according to claim 1:

wherein said thermoplastic film has interior surface along said bottom panel oriented towards said top;

wherein said thermoplastic film along said brim has top surface oriented away from said bottom panel;

wherein said top surface bounds an open end;

wherein said open end has a maximum open dimension; and wherein said container has a depth measured orthogonally away from said interior surface to said open end that is less than 75% of said maximum open dimension.

8. The container according to claim 1, where said container is devoid of adhesive between parts of said cradle that are in facing relationship with one another and is devoid of adhesive between parts of said insert in facing relationship with parts of said cradle.

9. The container according to claim 1, wherein said cradle, said insert, and said thermoplastic film have a combined weight, wherein cellulose fibers constitute more than 80% of said combined weight.

10. The container according to claim 1:

wherein said thermoplastic film has interior surface along said bottom panel oriented towards said top;

wherein said thermoplastic film along said brim has top surface oriented away from said bottom panel;

wherein said top surface bounds an open end;

wherein said open end has a maximum open dimension; and wherein said container has a depth measured orthogonally away from said interior surface to said open end that is from 20 mm to 150 mm.

11. A container comprising:

a paper-based cradle comprising:

a bottom panel;

a pair of opposing exterior end panels, wherein each exterior end panel is foldably connected to said bottom panel at an exterior end panel proximal end and extends to an exterior end panel distal end and is directed towards a top of said container, and wherein each exterior end panel comprises opposing exterior end panel lateral edges extending from said exterior end panel proximal end to said exterior end panel distal end;

a pair of opposing exterior side panels, wherein each exterior side panel is foldably connected to said bottom panel at an exterior side panel proximal end and extends to an exterior side panel distal end and is directed towards said top of said container, and wherein each exterior side panel comprises opposing exterior side panel lateral edges extending from said exterior side panel proximal end to said exterior side panel distal end; and four exterior corner panels, wherein each corner panel is foldably connected to one said exterior end panel lateral edge or one said exterior side panel lateral edge, wherein individually each exterior corner panel has a corner panel wing foldably connected thereto;

wherein individually each corner panel wing is in at least partial facing relationship with one said exterior end panel or one said exterior side panel;

a paper-based insert partially inboard of said cradle and comprising:

a continuous brim;

a pair of interior end panels foldably connected to said brim, wherein each said interior end panel is directed towards a bottom of said container and is in at least partial facing relationship with one said exterior end panel; and a pair of interior side panels foldably connected to said brim, wherein each said interior side panel is directed towards said bottom and is in at least partial facing relationship with one said exterior side panel; and a thermoplastic film inboard of said insert and joined to said brim, said bottom panel, said interior end panels, said interior side panels, said exterior end panels, said exterior side panels, said exterior corner panels, and said corner panel wings;

wherein individually each said interior side panel has one or more interior side panel apertures therethrough; and wherein said thermoplastic film is joined to said exterior side panels through said interior side panel apertures.

12. The container according to claim 11, wherein individually each said interior side panel has an interior side panel area not inclusive of said interior side panel apertures and said interior side panel apertures have a side panel aperture open area that is more than 20% of said interior side panel area.

13. The container according to claim 11 further comprising:

four interior corner panels foldably connected to said brim;

wherein individually each interior corner panel is in at least partial facing relationship with part of one said exterior corner panel.

14. The container according to claim 13:

wherein individually each interior corner panel is in wholly facing relationship with part of one exterior corner panel.

15. The container according to claim 11:

wherein said thermoplastic film has interior surface along said bottom panel oriented towards said top;

wherein said thermoplastic film along said brim has top surface oriented away from said bottom panel;

wherein said top surface bounds an open end;

wherein said open end has a maximum open dimension; and wherein said container has a depth measured orthogonally away from said interior surface to said open end that is less than 75% of said maximum open dimension.

16. The container according to claim 11, where said container is devoid of adhesive between parts of said cradle that are in facing relationship with one another and is devoid of adhesive between parts of said insert in facing relationship with parts of said cradle.

17. The container according to claim 11, wherein said cradle, said insert, and said thermoplastic film have a combined weight, wherein cellulose fibers constitute more than 80% of said combined weight.

18. The container according to claim 11:

wherein said thermoplastic film has interior surface along said bottom panel oriented towards said top;

wherein said thermoplastic film along said brim has top surface oriented away from said bottom panel;

wherein said top surface bounds an open end;

wherein said open end has a maximum open dimension; and wherein said container has a depth measured orthogonally away from said interior surface to said open end that is from 20 mm to 150 mm.

19. A container comprising:

a paper-based cradle comprising:

a bottom panel;

a pair of opposing exterior end panels, wherein each exterior end panel is foldably connected to said bottom panel at an exterior end panel proximal end and extends to an exterior end panel distal end and is directed towards a top of said container, and wherein each exterior end panel comprises opposing exterior end panel lateral edges extending from said exterior end panel proximal end to said exterior end panel distal end;

a pair of opposing exterior side panels, wherein each exterior side panel is foldably connected to said bottom panel at an exterior side panel proximal end and extends to an exterior side panel distal end and is directed towards said top of said container, and wherein each exterior side panel comprises opposing exterior side panel lateral edges extending from said exterior side panel proximal end to said exterior side panel distal end; and four exterior corner panels, wherein each corner panel is foldably connected to one said exterior end panel lateral edge or one said exterior side panel lateral edge, wherein individually each exterior corner panel has a corner panel wing foldably connected thereto;

wherein individually each corner panel wing is in at least partial facing relationship with one said exterior end panel or one said exterior side panel;

a paper-based insert partially inboard of said cradle and comprising:

a continuous brim;

a pair of interior end panels foldably connected to said brim, wherein each said interior end panel is directed towards a bottom of said container and is in at least partial facing relationship with one said exterior end panel;

a pair of interior side panels foldably connected to said brim, wherein each said interior side panel is directed towards said bottom and is in at least partial facing relationship with one said exterior side panel; and four interior corner panels foldably connected to said brim;

wherein individually each interior corner panel is in at least partial facing relationship with part of one said exterior corner panel; and a thermoplastic film inboard of said insert and joined to said brim, said bottom panel, said interior end panels, said interior side panels, said exterior end panels, said exterior side panels, said exterior corner panels, and said corner panel wings.

20. The container according to claim 19, wherein individually each interior corner panel is in wholly facing relationship with part of one exterior corner panel.

21. The container according to claim 19:

wherein said thermoplastic film has interior surface along said bottom panel oriented towards said top;

wherein said thermoplastic film along said brim has top surface oriented away from said bottom panel;

wherein said top surface bounds an open end;

wherein said open end has a maximum open dimension; and wherein said container has a depth measured orthogonally away from said interior surface to said open end that is less than 75% of said maximum open dimension.

22. The container according to claim 19, where said container is devoid of adhesive between parts of said cradle that are in facing relationship with one another and is devoid of adhesive between parts of said insert in facing relationship with parts of said cradle.

23. The container according to claim 19, wherein said cradle, said insert, and said thermoplastic film have a combined weight, wherein cellulose fibers constitute more than 80% of said combined weight.

24. The container according to claim 19:

wherein said thermoplastic film has interior surface along said bottom panel oriented towards said top;

wherein said thermoplastic film along said brim has top surface oriented away from said bottom panel;

wherein said top surface bounds an open end;

wherein said open end has a maximum open dimension; and wherein said container has a depth measured orthogonally away from said interior surface to said open end that is from 20 mm to 150 mm.

* * * * *